US006649338B2

(12) United States Patent
Mitsuhashi

(10) Patent No.: US 6,649,338 B2
(45) Date of Patent: Nov. 18, 2003

(54) SILVER SALT PHOTOTHERMOGRAPHIC IMAGING MATERIAL

(75) Inventor: Tsuyoshi Mitsuhashi, Hachimouji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/164,021

(22) Filed: Jun. 5, 2002

(65) Prior Publication Data

US 2003/0124473 A1 Jul. 3, 2003

(30) Foreign Application Priority Data

Jun. 11, 2001 (JP) ..... 2001-175473

(51) Int. Cl.[7] ..... G03C 1/498; G03C 1/09

(52) U.S. Cl. ..... 430/619; 430/264; 430/350; 430/531; 430/600; 430/601; 430/605

(58) Field of Search ..... 430/619, 264, 430/598, 350, 536, 600, 601, 605, 603

(56) References Cited

U.S. PATENT DOCUMENTS 6,387,604 B2 * 5/2002 Sampei
6,436,626 B1 * 8/2002 Kawahara et al. ..... 430/619
2001/0038977 A1 * 11/2001 Katoh ..... 430/350

* cited by examiner

*Primary Examiner*—Thorl Chea
(74) *Attorney, Agent, or Firm*—Squire Sanders & Dempsey, L.L.P.

(57) ABSTRACT

A silver salt photohermographic material is disclosed, comprising a support having provided thereon a light-sensitive layer containing light-sensitive silver halide, a light-insensitive organic silver salt and a binder, wherein the photohermographic material exhibits a gradation of 2.0 to 5.0 within the density region of 0.5 and 2.0 on a photographic characteristic curve obtained when the photothermographic material is subjected to exposure of 50 $\mu J/cm^2$ and thermal development at 124° C. for 16 sec.; the light-sensitive layer comprises lower and upper layers and a glass transition temperature of a binder contained in the lower layer being higher than that of a binder contained in the upper layer.

14 Claims, 1 Drawing Sheet

SILVER SALT PHOTOTHERMOGRAPHIC IMAGING MATERIAL

FIELD OF THE INVENTION

The present invention relates to silver salt black-and-white photothermographic imaging material (hereinafter, also simply denoted as a photothermographic material) with minimal unevenness in density and exhibiting enhanced sensitivity and superior silver image tone.

BACKGROUND OF THE INVENTION

In the field of graphic arts and medical treatment, there have been concerns in processing of photographic film with respect to effluent produced from wet-processing of image forming materials, and recently, reduction of the processing effluent is strongly demanded in terms of environmental protection and space savings. There has been desired a photothermographic dry imaging material for photographic use, capable of forming distinct black images exhibiting high sharpness, enabling efficient exposure by means of a laser imager or a laser image setter.

Known as such a technique are thermally developable silver salt photographic materials (which are the same as photothermographic materials, as described in the present invention) comprising on a support an organic silver salt, light-sensitive silver halide and a reducing agent, as described in D. Morgan and B. Shely, U.S. Pat. Nos. 3,152,904 and 3,487,075, and D. H. Klosterboer, "Thermally Processed Silver Systems" in IMAGING PROCESSES and MATERIALS, Neblette's Eighth Edition, edited by J. M. Sturge, V. Walworth, and A. Shepp (1969) page 279. The thermally developable silver salt photographic material provides a simply and environment-friendly system for users, without use of any processing solution.

These silver salt photothermographic materials comprise a light sensitive layer containing light sensitive silver halide grains as a photosensor and an organic silver salt as a silver ion source, which are thermally developed with a reducing agent at a temperature of 80 to 140° C. to form images, without being subjected to fixing. To achieve smooth supply of silver ions and minimize lowered transparency due to light scattering, much effort has been made to improve the shape of organic silver salt particles so as to appropriately arrange the salt in the light sensitive layer without adversely affecting light scattering.

However, in silver salt photothermographic materials, inclusion of an organic silver salt, silver halide grains and a reducing agent easily results in fogging during the storage time prior to thermal development. Furthermore, there are problems that the photothermographic materials, after exposure are usually developed at a temperature of 80 to 250° C. without being fixed, and the silver halide, organic silver salt and reducing agent concurrently remain in the layer, so that metallic silver is thermally or photolytically produced after storage over a long period of time, deteriorating image quality, such as silver image tone.

There were disclosed techniques for solving such problems in JP-A Nos. 6-208192 and 8-267934 (hereinafter, the term, JP-A refers to an unexamined, published Japanese Patent Application); U.S. Pat. No. 5,714,311 and references cited therein. These disclosed techniques had desired effects to some extents but were not sufficient as a technique to satisfy the level required in the market. In addition thereto, further enhanced image quality has been desired as a perpetual theme in silver salt photothermographic imaging materials. Specifically in the field of medical diagnostic imaging, further enhanced image quality is desired to effectuate more precise diagnosis.

SUMMARY OF THE INVENTION

In light of the foregoing, the present invention was accomplished. Thus, it is an object of the invention to provide a silver salt photothermographic imaging material exhibiting high image quality without causing unevenness in density and still maintaining superior silver image tone even after storage over a long period of time after having been subjected to thermal development, and an image recording method by the use thereof.

The foregoing object of the invention can be accomplished by the following constitution:

1. a silver salt photothermographic material comprising a support having provided thereon a light-sensitive layer containing light-sensitive silver halide, a light-insensitive organic silver salt and a binder, wherein the photothermographic material exhibits a gradation of 2.0 to 5.0 within the density region of 0.5 and 2.0 on a photographic characteristic curve obtained when the photothermographic material is subjected to exposure to light of 50 $\mu J/cm^2$ and thermal development at 124° C. for 16 sec.; the light-sensitive layer comprises at least two layers including a lower layer and a upper layer provided on the lower layer and a glass transition temperature of a binder contained in the lower layer is higher than that of a binder contained in the upper layer.

Further, preferred embodiments of the invention are as follows:

2. the photothermographic material described in 1. above, wherein a mean radius of spheres of influence of the lower layer (also denoted as r) than the upper layer is less than that of the upper layer (also denoted as r');
3. the photothermographic material described in 1. or 2. above, wherein the mean radius of spheres of influence of the upper layer (r') is 0.30 to 1.10 $\mu$m;
4. the photothermographic material described in 1., 2. or 3., wherein the light-sensitive layer contains a silver halide emulsion which has been sensitized with a chalcogen sensitizer; and
5. the photothermographic material described in any of 1. through 4. above, wherein the light-sensitive layer or light-insensitive layer contains a silver-saving agent.

DETAILED DESCRIPTION OF THE INVENTION

Figure 1:
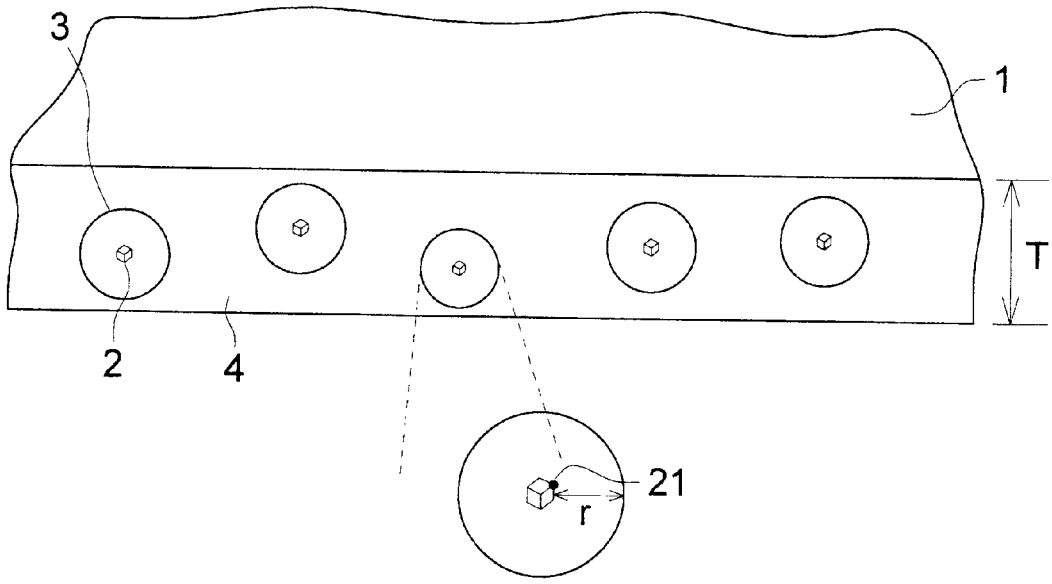
FIG. 1 illustrates spheres of influence of the invention.

In the invention, the sphere of influence refers to a region, which is formed around developed silver produced from light-sensitive silver halide and in which a light-insensitive organic silver salt has disappeared. The state thereof is illustrated in FIG. 1. As shown therein, in light-sensitive layer 1 (or emulsion layer) having a given thickness, T (which is usually within the range of 0.5 to 50 $\mu$m) and containing light-sensitive silver halide and light-insensitive organic silver salt, the silver halide is photolyzed upon exposure to light to form latent image 21, i.e., silver within silver halide grain 2. Further, when subjected to thermal development, such silver acts as a catalyst to allow reaction of reducing the organic silver salt to silver to proceed, producing nearly spherical, organic silver salt-disappeared portion 3. This disappearance portion is the sphere of influence. In the light-sensitive layer, portions 4, other than disappearance portion(s) remains undeveloped. When the projected area of a sphere of influence is approximated by a circle having the same area as the projected area, a radius of the sphere of influence is represented by a radius of the corresponding circle (shown as "r" in FIG. 1). Therefore, the mean sphere of influence radius is represented by an average value of the radiuses.

Such spheres of influence may overlap and overlapped spheres of influence are preferred. Thus, when the spheres of influence overlap, variation of catalytic action of the light-sensitive silver halide is readily minimized. The sphere of influence can be detected by projecting a sectional TEM (transmission electron microscope) image. The mean radius of spheres of influence can be determined based on the sectional TEM image.

In this respect, the exposure amount is one which is on the surface of the photothermographic material. Rehumidifying conditions of photothermographic materials to be measured are not specifically limited.

The sphere of influence is described in D. H. Klosterboer, "Thermally Processed Silver Systems" in IMAGING PROCESSES and MATERIALS, Neblette's Eighth Edition, edited by J. M. Sturge, V. Walworth and A. Shepp, Van Nostrand Reinhold, New York (1989); and Journal of Imaging Science and Technology, Vol. 40, No. 6, November/December 1996. In these references, values of the sphere of influence are exemplarily described. However, the sphere of influence described therein is not definite with respect to the exposure condition and enhancement of specific photographic performance as silver salt photothermographic imaging material is not intended therein.

In the invention, it was found that the relationship of the mean radius of the sphere of influence in the multi-layered light-sensitive layers was so controlled that the mean radius of the sphere of influence of the lower light-sensitive layer, located in the lower side (denoted as r), was less than that of the upper light-sensitive layer, located in the upper side (denoted as r'), thereby leading to minimized fog density, enhanced maximum density and minimized variation in density, caused by fluctuation of developing conditions. The ratio of the mean radius of the sphere of influence is preferably $0.01 \leqq r/r' \leqq 0.75$. In the upper light-sensitive layer, a mean radius of the sphere of influence of more than 1.10 $\mu$m results in increased fogging and a mean radius of less than 0.30 $\mu$m leads to reduced maximum density. Further, when the mean radius ratio of the sphere of influence falls outside the foregoing range, enhancement of all performance parameters cannot be achieved.

In the silver salt photothermographic material relating to the invention, control of the sphere of influence can be achieved by the appropriate combination of the following adjustments:

1) adjusting the average grain size and the grain size distribution of light-insensitive organic silver salt to the preferred range, as described later; 2) adjusting the ratio of a quantity of light-sensitive silver halide to that of light-insensitive organic silver salt to the preferred range described later; 3) adjusting a quantity of a reducing agent to the preferred range described later; 4) adjusting a quantity of an antifoggant to the preferred range described later; 5) adjusting a quantity of an image tone modifier to the preferred range described later; and 6) adjusting a glass transition point of a binder to the preferred range described later.

In the invention, the gradation is represented by a slope of a tangent on a characteristic curve, i.e., so-called point gamma. The point gamma is defined as follows: at a given point on a characteristic curve that is drawn using rectangular coordinates equal to each other in unit length, with density as ordinate and logarithmic exposure as abscissa, the tangent is drawn and the slope of the tangent is defined as point gamma. The silver salt photothermographic material according to the invention exhibits a gradation of 2.0 to 5.0 within the density region of 0.5 and 2.0 on a photographic characteristic curve obtained when the photothermographic material is subjected to exposure and thermal development. Thus, when exposed and thermally developed, the photothermographic material has a characteristic curve such that when drawn using rectangular coordinates equal to each other in unit length, with density as ordinate and common logarithmic exposure as abscissa, the characteristic curve provides a gradation (or point gamma) value of 2.0 to 5.0 at every point within the density range of from 0.5 to 2.0. A gradation less than 2.0 or more than 5.0 produced problems, such as unevenness in density and deteriorated sharpness.

In the determination of the gradation, the photothermographic material is subjected to exposure at 5 to 75 $\mu J/m^2$, and preferably 50 $\mu J/m^2$, as energy on the exposed surface of laser output and further subjected to thermal development at 123° C.±3° C. for 16 sec.±3 sec, and preferably 124° C. for 16 sec., according to a drum development system.

The organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (e.g., salts of gallic acid, oxalic acid, behenic acid, stearic acid, palmitic acid, lauric acid, etc.); carboxyalkylthiourea salts (e.g., 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (e.g., aldehydes such as formaldehyde, acetaldehyde, butylaldehyde), hydroxy-substituted acids (e.g., salicylic acid, benzoic acid, 3,5-dihydroxybenzoic acid, 5,5-thiodisalicylic acid, silver salts or complexes of thiones (e.g., 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidic acid and/or stearic acid are specifically preferred. A mixture of two or more kinds of organic silver salts is preferably used, enhancing developability and forming silver images exhibiting relatively high density and high contrast. For example, preparation by adding a silver ion solution to a mixture of two or more kinds of organic acids is preferable.

The organic silver salt compound can be obtained by mixing an aqueous-soluble silver compound with a compound capable of forming a complex. Normal precipitation, reverse precipitation, double jet precipitation and controlled double jet precipitation, as described in JP-A 9-127643 are preferably employed. For example, to an organic acid can be added an alkali metal hydroxide (e.g., sodium hydroxide, potassium hydroxide, etc.) to form an alkali metal salt soap of the organic acid (e.g., sodium behenate, sodium arachidinate, etc.), thereafter, the soap and silver nitrate are mixed by the controlled double jet method to form organic silver salt crystals. In this case, silver halide grains may be concurrently present.

Organic silver salt grains may be of almost any shape but are preferably tabular grains. Tabular organic silver salt grains are specifically preferred, exhibiting an aspect ratio of 3 or more and a needle form ratio of not less than 1.1 and less than 10.0 of a needle form ratio measured from the major face direction, thereby lessen anisotropy in shape of substantially parallel, two faces having the largest area (so-called major faces). The more preferred needle form ratio is not less than 1.1 and less than 5.0.

The expression "comprises tabular organic silver salt particles exhibiting an aspect ratio of 3 or more" means that at least 50% by number of the total organic silver salt particles is accounted for by tabular particles having an aspect ratio of 3 or more. The organic silver salt particles having an aspect ratio of 3 or more accounts for more preferably at least 60% by number, still more preferably at least 70% by number, and most preferably at least 80% by number. The tabular organic silver salt particle having an aspect ratio of 3 or more refers to an organic salt particle exhibiting a ratio of particle diameter to particle thickness, a so-called aspect ratio (also denoted as AR) of 3 or more, which is defined as below:

$$AR = \text{diameter } (\mu m)/\text{thickness } (\mu m)$$

wherein when an organic silver salt particle is approximated to be a rectangular parallelepiped, the diameter is the maximum edge length (also denoted as MX LNG) and the thickness is the minimum edge length (also denoted as MNLNG).

The aspect ratio of the tabular organic silver salt particles is preferably within the range of 3 to 20, and more preferably 3 to 10. In the case of an aspect ratio of less than 3, the organic salt particles easily form closest packing and in the case of the aspect ratio being excessively high, organic silver salt particles are easily superposed and dispersed in a coating layer in the form of being brought into contact with each other, easily causing light scattering and leading to deterioration in transparency of the photothermographic material.

The grain diameter of the foregoing organic silver salt was determined in the following manner. An organic silver salt dispersion was diluted, dispersed on the grid provided with a carbon support membrane, and then photographed at a direct magnification of 5,000 times using a transmission type electron microscope (TEM, 2000 FX type, available from Nihon Denshi Co., Ltd., direct magnification factor of 5,000). The thus obtained negative electron micrographic images were read as a digital image by a scanner to determine the diameter (circular equivalent diameter) using appropriate software. At least 300 grains were so measured to determine an average diameter.

The grain thickness is determined using a transmission type electron microscope in the following manner. First, a light sensitive layer, coated onto a support, is pasted onto a suitable holder employing an adhesive and is cut perpendicular to the support surface employing a diamond knife to prepare an ultra-thin slice, at a thickness of 0.1 to 0.2 $\mu$m. The thus prepared ultra-thin slice is supported on a copper mesh, and is placed onto a carbon membrane, which has been made to be hydrophilic by means of a glow discharge.

Then, while cooling the resulting slice to not more than −130° C., the image in a bright visual field is observed at a magnification of 5,000 to 40,000 employing a transmission electron microscope (hereinafter referred to as TEM), and then images are quickly recorded employing an image plate, a CCD camera, etc. In such a case, it is recommended to suitably select a portion of said slice, which has neither been torn nor distorted in the visual field for observation.

The carbon membrane, which is supported by an organic film such as an extremely thin collodion, Formvar, etc., is preferably employed, and a film composed of only carbon, which is obtained by forming the film on a rock salt substrate and then dissolving away the substrate or by removing the foregoing organic film, employing an organic solvent or ion etching, is more preferably employed. The acceleration voltage of said TEM is preferably 80 to 400 kV, and is most preferably 80 to 200 kV.

Details of other means such as electron microscopic technology and sample preparation techniques can be referred to in "Igaku.Seibutsugaku Denshikenbikyo Kansatsuho (Medical and Biological Electron Microscopy", edited by Nippon Denshikenbikyo Gakkai, Kanto-Shibu, (Maruzen), and "Denshikenbikyo Seibutsu Shiryo Sakuseiho (Preparation Method of Biological Samples for Electron Microscopy)", edited by Nippon Denshikenbikyo Gakkai, Kanto-Shibu, (Maruzen).

The TEM image, recorded in an appropriate medium, is decomposed to at least 1024×1024 pixels or preferably at least 2048×2048 pixels, and is then subjected to image processing employing a computer. In order to carry out image processing, an analogue image recorded on a film strip is converted into a digital image employing a scanner etc., and the resulting image is preferably subjected to shading correction, contrast-edge enhancement, etc., based on specific requirements. Thereafter, a histogram is prepared and the portions corresponding to organic silver are extracted employing binary processing. At least 300 grains of the organic silver salt were manually measured with respect to the thus extracted thickness employing appropriate software.

The average of the needle ratio of the tabular organic silver salt grains is determined according to the procedures described below.

First, a light sensitive layer, comprising tabular organic silver salt grains, is allowed to swell by employing an organic solvent which is capable of dissolving the binder of said light sensitive layer, and said layer is then peeled from the support. The operation is repeated five times, in which the peeled layer is subjected to ultrasonic cleaning with the above-mentioned solvent, and centrifugal separation, and the supernatant is removed. Further, the above-mentioned process is carried out under a photographic safelight.

Subsequently, dilution is carried out employing MEK (methyl ethyl ketone) so that the concentration of the organic silver solid portion becomes 0.01 percent. After carrying out ultrasonic dispersion, the resulting is dropped onto a polyethylene terephthalate film which has been made to be hydrophilic employing a glow discharge, and is subsequently dried.

The film, on which said grains are placed, is subjected to oblique evaporation of 3 nm thickness Pt—C by an electron beam from a 30° angle to the film surface employing a vacuum evaporation unit, and thereafter, is preferably employed for observation.

Similarly, details thereof can be referred to "Igaku.Seibutsugaku Denshikenbikyo Kansatsuho (Medical and Biological Electron Microscopy", edited by Nippon Denshikenbikyo Gakkai, Kanto-Shibu, (Maruzen), and "Denshikenbikyo Seibutsu Shiryo Sakuseiho (Preparation Method of Biological Samples for Electron Microscopy)", edited by Nippon Denshikenbikyo Gakkai, Kanto-Shibu, (Maruzen), as described above.

The prepared sample is observed through a secondary electron image, obtained by employing a field emission scanning electron microscope (hereinafter referred to as PE-SEM) under a magnification of 5,000 to 20,000 at an acceleration voltage of 2 to 4 kV, and the resulting image is stored on suitable recording media.

For the above-mentioned processing, it is convenient to use a device which is capable of directly recording the memory data as digital information, which is obtained by AD converting image signals from the electron microscope body. However, analogue images recorded onto Polaroid film etc. can be converted to digital images employing a scanner etc., and the resulting images may be employed upon carrying out shading correction, contrast enhancement as well as edge enhancement, etc. if desired.

One image recorded in a suitable medium is decomposed to at least 1024×1024 pixels and is preferably decomposed to 2048×2048 pixels. Said decomposed image is preferably subjected to image processing employing a computer.

Procedures of the above-mentioned image processing are as follows. First, a histogram is prepared and portions corresponding to tabular organic silver salt grains having an aspect ratio of 3 or more are extracted employing binary processing. Inevitable coagulated grains are cut employing a suitable algorithm or a manual operation and are subjected to boarder extract. Thereafter, both maximum length (MX LNG) and minimum width (WIDTH) between two parallel lines are measured for at least 1000 grains, and the needle ratio of each grain is obtained employing the formula described below. The maximum length (MX LNG) is the maximum value of the straight length between two points within a grain. The minimum width between two parallel lines is the minimum distance of two parallel lines drawn circumscribing the grain.

Needle ratio=(*MX LNG*)/(WIDTH)

Thereafter, the number average of the needle ratio is calculated for all measured particles. When measurements are carried out employing the above-mentioned procedures, it is desirable that in advance, employing a standard sample, the length correction (scale correction) per pixel as well as two-dimensional distortion correction of the measurement system is adequately carried out. As the standard sample, Uniform Latex Particles (DULP) marketed by Dow Chemical Co. in the USA are suitable. Polystyrene particles having a variation coefficient of less than 10 percent for a diameter of 0.1 to 0.3 $\mu$m are preferred. Specifically, a type having a particle diameter of 0.212 $\mu$m as well as a standard deviation of 0.0029 $\mu$m is commercially available.

Details of image processing technology may be had by referring to "Gazoshori Oyogijutsu (Applied Technology in Image Processing)", edited by Hiroshi Tanaka, (Kogyo Chosa Kai). Image processing programs or apparatuses are not particularly restricted, as long as the above-mentioned operation is possible. Cited as one example is Luzex-III, manufactured by Nireko Co.

Methods to prepare organic silver salt grains having the above-mentioned shape are not particularly restricted. The optimization of various conditions such as maintaining the mixing state during the formation of an organic acid alkali metal salt soap and/or the mixing state during the addition of silver nitrate to said soap. After tabular organic silver salt grains employed in the present invention are preliminarily dispersed together with binders, surface active agents, etc., if desired, the resulting mixture is preferably dispersed and pulverized by a media homogenizer, a high pressure homogenizer, or the like. During said preliminary dispersion, ordinary stirrers such as an anchor type, a propeller type, etc., a high speed rotation centrifugal radial type stirrer (Dissolver), as a high speed shearing stirrer (homomixer) may be employed.

Furthermore, employed as said media homogenizers may be rolling mills such as a ball mill, a satellite ball mill, a vibrating ball mill, medium agitation mills such as a bead mill, atriter, and others such as a basket mill. Employed as high pressure homogenizers may be various types such as a type in which collision occurs against a wall or a plug, a type in which liquid is divided into a plurality of portions and said portions are subjected to collision with each other, a type in which liquid is forced to pass through a narrow orifice, etc. Examples of ceramics employed as the ceramic beads include $Al_2O_3$, $BaTiO_3$, $SrTiO_3$, MgO, ZrO, BeO, $Cr_2O_3$, $SiO_3$, $SiO_2$—$Al_2O_3$, $Cr_2O_3$—MgO, MgO—CaO, MoO—C, MgO—$Al_2O_3$ (spinel), SiC, $TiO_2$, $K_2O$, $Na_2O$, BaO, PbO, $B_2O_3$, $BeAl_2O_4$, $Y_3Al_5O_{12}$, $ZrO_2$—$Y_2O_3$ (cubic zirconia), 3BeO—$Al_2O_3$—$6SiO_2$ (artificial emerald), C (artificial diamond), $SiO_2$—$nH_2O$, silicone nitride, yttrium-stabilized-zirconia, zirconia-reinforced-alumina. Yttrium-stabilized-zirconia and zirconia-reinforced-alumina are preferably employed in view that little impurity is generated by friction among the beads or the classifier during classifying them. The ceramics containing zirconia are called zirconia as an abbreviation.

In devices employed for dispersing the tabular organic silver salt grains employed in the present invention, preferably employed as the members which are in contact with the organic silver salt grains are ceramics such as zirconia, alumina, silicone nitride, boron nitride, or diamond. Of these, zirconia is the one most preferably employed.

While carrying out of the above-mentioned dispersion, the binder is preferably added so as to achieve a concentration of 0.1 to 10 wt % with reference to the weight of the organic silver salt, and the temperature is preferably maintained at no less than 45° C. from the preliminary dispersion to the main dispersion process. An example of the preferable operation conditions of a homogenizer, when employing high-pressure homogenizer as the dispersing machine, is twice or more operations at 29.42 to 98.06 MPa.

In the case when a media-dispersing machine is employed, a circumferential speed of 6 to 13 m/sec. is preferable.

In one preferred embodiment of this invention, light sensitive silver halide used in this invention is subjected to chemical sensitization which is performed using an organic sensitizer containing a chalcogen atom in the absence of an oxidizing agent during the manufacturing process of the photothermographic material, the silver halide being mixed with the organic silver salt, dispersed, dewatered and dried. One feature of the light sensitive emulsion used in the invention is that when the cross section, vertical to the support of the photothermographic material is observed through an electron microscope, organic silver salt particles exhibiting a grain projected area of less than 0.025 $\mu m^2$ account for at least 70% of the total grain projected area and organic silver salt particles exhibiting a grain projected area of not less than 0.2 $\mu m^2$ account for not more than 10% of the total grain projected area. In such a case, coagulation of the organic silver salt grains is minimized in the light sensitive emulsion, resulting in a homogeneous distribution thereof.

The conditions for preparing the light sensitive emulsion having such a feature are not specifically limited but include, for example, mixing at the time of forming an alkali metal soap of an organic acid and/or mixing at the time of adding silver nitrate to the soap being maintained in a favorable state, optimization of the ratio of the soap to the silver nitrate, the use of a media dispersing machine or a high pressure homogenizer for dispersing pulverization, wherein dispersion is conducted preferably in a binder content of 0.1 to 10% by weight, based on the organic silver salt, the dispersion including the preliminary dispersion is carried out preferably at a temperature of not higher than 45° C., and a dissolver, as a stirrer is preferably operated at a circumferential speed of at least 2.0 m/sec.

The projected area of organic silver salts grain having a specified projection area and the desired proportion thereof, based on the total grain projection area can be determined by the method using a transmission type electron microscope (TEM) in a similar manner, as described in the determination of the average thickness of tabular grains having an aspect ratio of 3 or more. In this case, coagulated grains are regarded as a single grain when determining the grain area (AREA). At least 1000 grains, and preferably at least 2000 grains are measured to determine the area and classified into three groups, i.e., A: less than 0.025 $\mu m^2$, B: not less than 0.025 $\mu m^2$ and less than 0.2 $\mu m^2$ and C: more than 0.2 $\mu m^2$. In this invention, it is preferable that the total projected area of grains falling within the range of "A" accounts for at least 70% of the projected area of the total grains and the total projected area of grains falling within the range of "C" accounts for not more than 10% of the projected area of total grain.

As mentioned earlier, details of image processing technology may be had by referring to "Gazoshori Oyogijutsu (Applied Technology in Image Processing)", edited by Hiroshi Tanaka, (Kogyo Chosa Kai). Image processing programs or apparatuses are not particularly restricted, as long as the above-mentioned operation is possible. Cited as one example is Luzex-III, manufactured by Nireko Co.

The organic silver salt grains used in this invention are preferably monodisperse. The degree of monodispersion is preferably 1 to 30% and monodisperse particles in this range lead to the desired high density images. The degree of monodispersion is defined as below:

Degree of grain dispersity=(standard deviation of particle size)/(average particle size)×100 (%).

The average particle size of organic silver salt is preferably 0.01 to 0.8 $\mu m$, and more preferably 0.05 to 0.5 $\mu m$. The particle size refers to the diameter of a circle having an area equivalent to the projected area of the particle (i.e., circular equivalent diameter).

To prevent hazing of the photothermographic material, the total amount of silver halide and organic silver salt is preferably 0.5 to 2.2 g in equivalent converted to silver per $m^2$, thereby leading to high contrast images.

The light-sensitive silver halide grains used in the invention will be described. The light-sensitive silver halide grains are referred to as those which can absorb visible or infrared light as an inherent property of silver halide crystal through the artificial or physicochemical process and can cause physicochemical change, upon absorption of visible or infrared light, in the interior and/or on the surface of the silver halide crystal.

The silver halide grains used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred. The halide composition of silver halide is not specifically limited and may be any one of silver chloride, silver chlorobromide, silver iodochlorobromide, silver bromide, silver iodobromide and silver iodide.

The grain forming process is usually classified into two stages of formation of silver halide seed crystal grains (nucleation) and grain growth. These stages may continuously be conducted, or the nucleation (seed grain formation) and grain growth may be separately performed. The controlled double-jet precipitation, in which grain formation is undergone with controlling grain forming conditions such as pAg and pH, is preferred to control the grain form or grain size. In cases when nucleation and grain growth are separately conducted, for example, a soluble silver salt and a soluble halide salt are homogeneously and promptly mixed in an aqueous gelatin solution to form nucleus grains (seed grains), thereafter, grain growth is performed by supplying soluble silver and halide salts, while being controlled at a pAg and pH to prepare silver halide grains. After completing the grain formation, the resulting silver halide grain emulsion is subjected to desalting to remove soluble salts by commonly known washing methods such as a noodle washing method, a flocculation method, a ultrafiltration method, or electrodialysis to obtain desired emulsion grains.

In order to minimize cloudiness after image formation and to obtain excellent image quality, the less the average grain size, the more preferred, and the average grain size is preferably not more than 0.2 $\mu m$, more preferably between 0.01 and 0.17 $\mu m$, and still more preferably between 0.02 and 0.14 $\mu m$. The average grain size as described herein is defined as an average edge length of silver halide grains, in cases where they are so-called regular crystals in the form of cube or octahedron. Furthermore, in cases where grains are tabular grains, the grain size refers to the diameter of a circle having the same area as the projected area of the major faces. Furthermore, silver halide grains are preferably monodisperse grains. The monodisperse grains as described herein refer to grains having a coefficient of variation of grain size obtained by the formula described below of not more than 7%; more preferably not more than 5%, still more preferably not more than 3%, and most preferably not more than 1%.

Coefficient of variation of grain size=standard deviation of grain diameter/average grain diameter×100 (%)

The grain form can be of almost any one, including cubic, octahedral or tetradecahedral grains, tabular grains, spherical grains, bar-like grains, and potato-shaped grains. of these, cubic grains, octahedral grains, tetradecahedral grains and tabular grains are specifically preferred.

The aspect ratio of tabular grains is preferably 1.5 to 100, and more preferably 2 to 50. These grains are described in U.S. Pat. No. 5,264,337, 5,314,798 and 5,320,958 and desired tabular grains can be readily obtained. Silver halide grains having rounded corners are also preferably employed.

Crystal habit of the outer surface of the silver halide grains is not specifically limited, but in cases when using a spectral sensitizing dye exhibiting crystal habit (face) selectivity in the adsorption reaction of the sensitizing dye onto the silver halide grain surface, it is preferred to use silver halide grains having a relatively high proportion of the crystal habit meeting the selectivity. In cases when using a sensitizing dye selectively adsorbing onto the crystal face of a Miller index of [100], for example, a high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

It is preferred to use low molecular gelatin having an average molecular weight of not more than 50,000 in the preparation of silver halide grains used in the invention, specifically, in the stage of nucleation. Thus, the low molecular gelatin has an average molecular eight of not more than 50,000, preferably 2,000 to 40,000, and more preferably 5,000 to 25,000. The average molecular weight can be determined by means of gel permeation chromatography. The low molecular weight gelatin can be obtained by subjecting an aqueous gelatin conventionally used and having an average molecular weight of ca. 100,000 to enzymatic hydrolysis, acid or alkali hydrolysis, thermal degradation at atmospheric pressure or under high pressure, or ultrasonic degradation.

The concentration of dispersion medium used in the nucleation stage is preferably not more than 5% by weight, and more preferably 0.05 to 3.0% by weight.

In the preparation of silver halide grains, it is preferred to use a compound represent by the following formula, specifically in the nucleation stage:

$$YO(CH_2CH_2O)m(C(CH_3)CH_2O)p(CH_2CH_2O)nY$$

where Y is a hydrogen atom, —$SO_3M$ or —CO—B—COOM, in which M is a hydrogen atom, alkali metal atom, ammonium group or ammonium group substituted by an alkyl group having carbon atoms of not more than 5, and B is a chained or cyclic group forming an organic dibasic acid; m and n each are 0 to 50; and p is 1 to 100. Polyethylene oxide compounds represented by foregoing formula have been employed as a defoaming agent to inhibit marked foaming occurred when stirring or moving emulsion raw materials, specifically in the stage of preparing an aqueous gelatin solution, adding a water-soluble silver and halide salts to the aqueous gelatin solution or coating an emulsion on a support during the process of preparing silver halide photographic light sensitive materials. A technique of using these compounds as a defoaming agent is described in JP-A No. 44-9497. The polyethylene oxide compound represented by the foregoing formula also functions as a defoaming agent during nucleation. The compound represented by the foregoing formula is used preferably in an amount of not more than 1%, and more preferably 0.01 to 0.1% by weight, based on silver.

The compound is to be present at the stage of nucleation, and may be added to a dispersing medium prior to or during nucleation. Alternatively, the compound may be added to an aqueous silver salt solution or halide solution used for nucleation. It is preferred to add it to a halide solution or both silver salt and halide solutions in an amount of 0.01 to 2.0% by weight. It is also preferred to make the compound represented by formula [5] present over a period of at least 50% (more preferably, at least 70%) of the nucleation stage.

The temperature during the stage of nucleation is preferably 5 to 60° C., and more preferably 15 to 50° C. Even when nucleation is conducted at a constant temperature, in a temperature-increasing pattern (e.g., in such a manner that nucleation starts at 25° C. and the temperature is gradually increased to reach 40° C. at the time of completion of nucleation) or its reverse pattern, it is preferred to control the temperature within the range described above.

Silver salt and halide salt solutions used for nucleation are preferably in a concentration of not more than 3.5N, and more preferably 0.01 to 2.5N. The flow rate of aqueous silver salt solution is preferably $1.5\times10^{-3}$ to $3.0\times10^{-1}$ mol/min per lit. of the solution, and more preferably $3.0\times10^{-3}$ to $8.0\times10^{-2}$ mol/min. per lit. of the solution. The pH during nucleation is within a range of 1.7 to 10, and since the pH at the alkaline side broadens the grain size distribution, the pH is preferably 2 to 6. The pBr during nucleation is 0.05 to 3.0, preferably 1.0 to 2.5, and more preferably 1.5 to 2.0.

Silver halide may be incorporated into an image forming layer by any means, in which silver halide is arranged so as to be as close to reducible silver source as possible. It is general that silver halide, which has been prepared in advance, added to a solution used for preparing an organic silver salt. In this case, preparation of silver halide and that of an organic silver salt are separately performed, making it easier to control the preparation thereof. Alternatively, as described in British Patent 1,447,454, silver halide and an organic silver salt can be simultaneously formed by allowing a halide component to be present together with an organic silver salt-forming component and by introducing silver ions thereto.

Silver halide can also be prepared by reacting a halogen containing compound with an organic silver salt through conversion of the organic silver salt. Thus, a silver halide-forming component is allowed to act onto a pre-formed organic silver salt solution or dispersion or a sheet material containing an organic silver salt to convert a part of the organic silver salt to photosensitive silver halide.

The silver halide-forming components include inorganic halide compounds, onium halides, halogenated hydrocarbons, N-halogeno compounds and other halogen containing compounds. These compounds are detailed in U.S. Pat. No. 4,009,039, 3,457,075 and 4,003,749, British Patent 1,498,956 and JP-A 53-27027 and 53-25420. Exemplary examples thereof include inorganic halide compound such as a metal halide and ammonium halide; onium halides, such as trimethylphenylammonium bromide, cetylethyldimethylammonium bromide, and trimethylbenzylammonium bromide; halogenated hydrocarbons, such as iodoform, bromoform, carbon tetrachloride and 2-brom-2-methylpropane; N-halogenated compounds, such as N-bromosucciimde, N-bromophthalimide, and N-bromoacetoamide; and other halogen containing compounds, such as triphenylmethyl chloride, triphenylmethyl bromide, 2-bromoacetic acid, 2-bromoethanol and dichlorobenzophenone. As described above, silver halide can be formed by converting a part or all of an organic silver salt to silver halide through reaction of the organic silver salt and a halide ion. The silver halide separately prepared may be used in combination with silver halide prepared by conversion of at least apart of an organic silver salt. The silver halide which is separately prepared or prepared through conversion of an organic silver salt is used preferably in an amount of 0.001 to 0.7 mol, and more preferably 0.03 to 0.5 mol per mol of organic silver salt.

Silver halide used in the invention preferably occludes ions of metals belonging to Groups 6 to 11 of the Periodic Table. Preferred as the metals are W; Fe, Co, Ni, Cu, Ru, Rh, Pd, Re, Os, Ir, Pt and Au. The metal complex compound may be used alone or in combination of the same kinds or different kinds thereof. The metal ion may be introduced into silver halide in the form of a metal salt or metal complex or metal complex ion. The content is $1\times10^{-9}$ to $1\times10^{-2}$ mol per mol of silver halide, and more preferably $1\times10^{-8}$ to $1\times10^{-4}$ mol per mol of silver halide.

Silver halide grain emulsions used in the invention may be desalted after the grain formation, using the methods known in the art, such as the noodle washing method and flocculation process.

Silver halide emulsions used in the silver salt photothermographic materials relating to the invention are preferably subjected to chalcogen sensitization. Of chalcogen sensitizers, compound represented by the following formula (1-1) or (1-2):

formula (1-1)

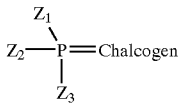

formula (1-2)

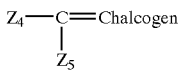

In formula (1-1), $Z_1$, $Z_2$ and $Z_3$ are each an aliphatic group, an aromatic group, a heterocyclic group, —$OR_7$, —$NR_8(R_9)$, $sR_{10}$, $SeR_{11}$, a halogen atom, or a hydrogen atom, in which $R_7$, $R_{10}$ and $R_{11}$ are each an aliphatic group, an aromatic group, a heterocyclic group, a hydrogen atom or a cation, $R_8$ and $R_9$ are each an aliphatic group, an aromatic group, a heterocyclic group or a hydrogen atom.

The aliphatic group represented by $Z_1$, $Z_2$, $Z_3$, $R_7$, $R_8$, $R_9$, $R_{10}$ and $R_{11}$ is an alkyl group, alkenyl group, alkynyl group, or aralkyl group (e.g., methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl, phenethyl); The aromatic group represented by $Z_1$, $Z_2$, $Z_3$, $R_7$, $R_8$, $R_9$, $R_{10}$ and $R_{11}$ is a monocyclic or condensed aryl group (e.g., phenyl, pentafluorophenyl, 4-chlorophenyl, 3-sulfophenyl, α-naphthyl, 4-methylphenyl).

The heterocyclic group represented by $Z_1$, $Z_2$, $Z_3$, $R_7$, $R_8$, $R_9$, $R_{10}$ and $R_{11}$ is a saturated or unsaturated, 3- to 10-membered heterocyclic group containing an oxygen or sulfur atom (e.g., pyridyl, thienyl, furyl, thiazolyl, imidazolyl, benzimidazolyl). The cation represented by $R_7$, $R_{10}$ and $R_{11}$ is an alkali metal atom or ammonium ion; the halogen atom represented by $Z_1$, $Z_2$ and $Z_3$ is fluorine, chlorine, bromine, iodine. In the formula (1-1), $Z_1$, $Z_2$ and $Z_3$ are preferably an aliphatic group, aromatic group or —$OR_7$, in which $R_7$ is an aliphatic group or aromatic group. $Z_1$ and $Z_2$, $Z_2$ and $Z_3$, or $Z_3$ and $Z_1$ may combine with each other to form a ring. In the invention, the term, chalcogen represents sulfur, selenium or tellurium.

In formula (1-2), $Z_4$ and $Z_5$ are each an alkyl group (e.g., methyl, ethyl, butyl, adamantly, t-octyl), alkenyl group (e.g., vinyl, propenyl), aralkyl group (e.g., benzyl, phenethyl), aryl group (e.g., phenyl, pentafluorophenyl, 4-chlorophenyl, 3-nitophenyl, 4-octylsulfamoylphenyl, α-naphthyl), heterocyclic group (e.g., pyridyl, thienyl, furyl, imidazolyl), —$NR_1(R_2)$, —$OR_3$ or —$SR_4$. $R_1$, $R_2$, $R_3$ and $R_4$, which may be the same or different, are each an alkyl group, aralkyl group, aryl group or a heterocyclic group. Examples of the alkyl group, aralkyl group, aryl group or a heterocyclic group are the same as defined in Z1 of formula (1-1). $R_1$ and $R_2$ may be a hydrogen atom or anacyl group (e.g., acetyl, propanoyl, benzoyl, heptafluorobutanoyl, difluoroacetyl, 4-nitrobenzoyl, α-naphthyl, 4-trifluoromethylbenzoyl). $Z_4$ and $Z_5$ may combine with each other to form a ring. The term, chalcogen represents sulfur, selenium or tellurium.

The chalcogen sensitizer represented by formula (1-1) or (1-2) reacts with silver ions on silver halide grains, irrespective of the presence/absence of an oxidizing agent, to form a sensitization nucleus, performing chemical sensitization. The compound represented by formula (1-1) or (1-2) can be readily synthesized in accordance with the methods known in the art.

Exemplary examples of the compound represented by formula (1-1) or (1-2) are shown below but are not limited to these.

1-14

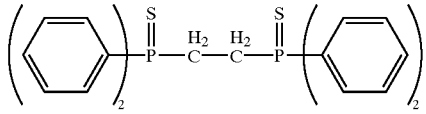

1-15

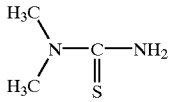

1-16

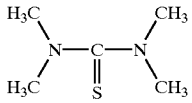

1-17

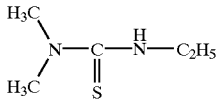

1-18

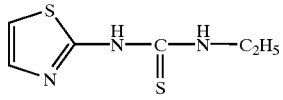

1-19

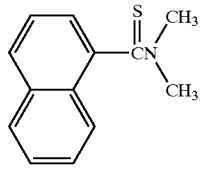

1-20

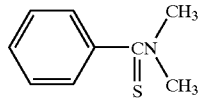

1-21

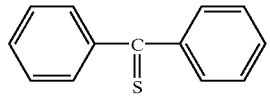

1-22

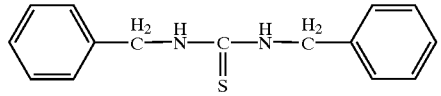

1-23

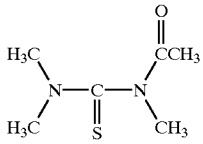

-continued
1-24
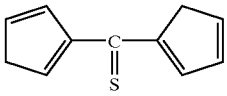
1-25
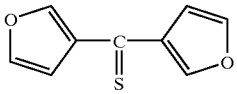
1-26
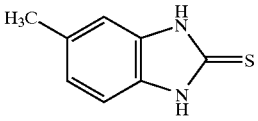
1-27
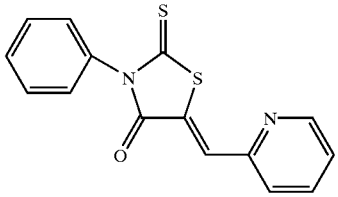
1-28
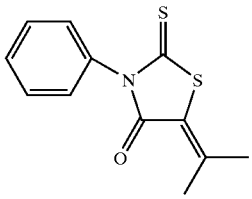
1-29
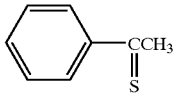
1-30
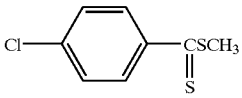
1-31
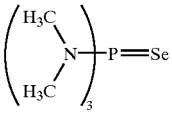
1-32
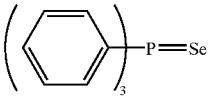
1-33
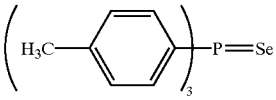
1-34
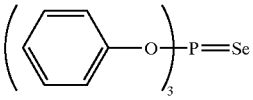
1-35
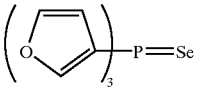
1-36
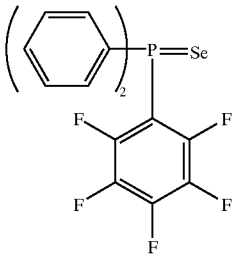
1-37
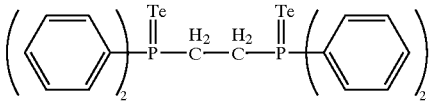
1-38
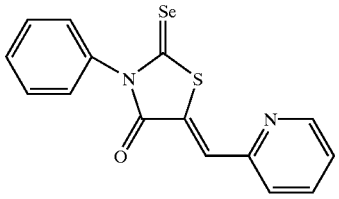
1-39
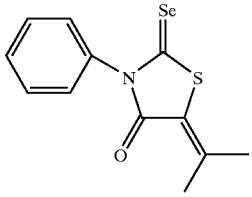
1-40
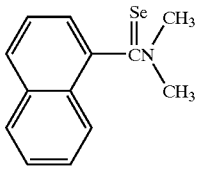
1-41
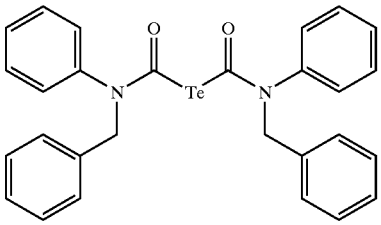
1-42
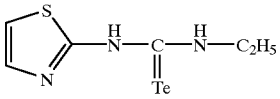
1-43
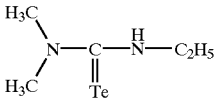
The chalcogen sensitizer is used in amounts depending on the kind thereof, silver halide grains, and chemical sensitization environment, and preferably in an amount of $10^{-8}$ to $10^{-2}$, and more preferably $10^{-5}$ to $10^{-3}$ mol per mol of total of silver halide and organic silver salt. In the invention, the chemical sensitization environment is not specifically limited, but the pH is preferably 4 to 10, and more preferably 5 to 8; the temperature is preferably 10 to 35° C., and more preferably 15 to 27° C., specifically, in a silver halide emulsion comprising an aqueous gelatin dispersion, the temperature is preferably 30 to 65° C., and more preferably 40 to 55° C. As is known in the art, the presence of silver halide solvents such as thiocyanates increases silver ions on the surface of silver halide, promoting chemical sensitization. Similarly, there may be employed corrosive material, including dibromobromate compounds {$HBr[Br_2]$-containing compound, such as pyridine dibromobromate, bis(dimethylacetoamide)dibromobromate}, halogen compounds (e.g., $FeBr_3$, $FeCl_3$), halogen ($Br_2$) and acids (e.g., hydrochloric acid, acetic acid). Promotion of decomposition of the chalcogen sensitizer can be achieved by varying a pH of the silver halide emulsion.

The chalcogen sensitizer may be used alone or in combination thereof, or together with commonly known chemical sensitizers. For example, in cases where the chalcogen of the chalcogen sensitizer is sulfur, the chalcogen sensitizer may be combined with commonly known sulfur sensitizers, selenium sensitizers, tellurium sensitizers, reduction sensitizers or noble metal sensitizers; in the case of the chalcogen being selenium, the chalcogen sensitizer may be combined with commonly known sulfur sensitizers, selenium sensitizers, tellurium sensitizers, reduction sensitizers or noble metal sensitizers; in the case of the chalcogen being tellurium, the chalcogen sensitizer may be combined with commonly known sulfur sensitizers, selenium sensitizers, tellurium sensitizers, reduction sensitizers or noble metal sensitizers.

The chalcogen sensitizer may be used through solution in an appropriate organic solvent, including alcohols (e.g., methanol, ethanol, propanol, fluorinated alcohols), ketones (e.g., acetone, methyl ethyl ketone), dimethylformamide, dimethylsulfoxide, and methyl cellosolve. Alternatively, an emulsion-dispersing technique may be employed, in which solution is prepared using oil such as dibutyl phthalate, tricresyl phthalate, glyceryl triacetate or diethyl phthalate, and an auxiliary solvent such as ethyl acetate or cyclohexanone, and is mechanically dispersed to form an emulsion. Solid particle dispersion is also employed, in which powdery chalcogen sensitizer is dispersed in water using a ball mill, colloid mill or a ultrasonic homogenizer.

With regard to the difference in constitution between a conventional silver salt photographic material and a photothermographic imaging material, the photothermographic imaging material contains relatively large amounts of light sensitive silver halide, a carboxylic acid silver salt and a reducing agent which often cause fogging and silver printing-out (print out silver). In the photothermographic imaging material, therefore, an enhanced technique for antifogging and image-lasting is needed to maintain storage stability not only before development but also after development. In addition to commonly known aromatic heterocyclic compounds to restrain growth of fog specks and development thereof, there were used mercury compounds having a function of allowing the fog specks to oxidatively die away. However, such a mercury compound causes problems with respect to working safety and environment protection.

Next, antifoggants and image stabilizers used in the photothermographic imaging material relating to the invention will be described.

As a reducing agent used in photothermographic materials are employed reducing agents containing a proton, such as bisphenols and sulfonamidophenols. Accordingly, a compound generating a labile species which is capable of abstracting a proton to deactivate the reducing agent is preferred. More preferred is a compound as a non-colored photo-oxidizing substance, which is capable of generating a free radical as a labile species on exposure. Any compound having such a function is applicable. However, a halogen radical, which easily forms silver halide is not preferred. An organic free radical composed of plural atoms is preferred. Any compound having such a function and exhibiting no adverse effect on the photothermographic material is usable irrespective of its structure. Of such free radical generation compounds, a compound containing an aromatic, and carbocyclic or heterocyclic group is preferred, which provides stability to the generated free radical so as to be in contact with the reducing agent for a period sufficient to react with the reducing agent to deactivate it. Representative examples of such compounds include biimidazolyl compounds and iodonium compounds.

Of such imidazolyl compounds, a compound represented by the following formula [2] is preferred:

formula [2]

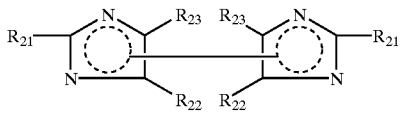

wherein $R_{21}$, $R_{22}$ and $R_{23}$ (which may be the same or different) each are a hydrogen atom, an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a hydrogen atom, a halogen atom, an aryloxyl (e.g., phenoxy), an alkylthio group (e.g., methlthio, butylthio), an arylthio group (e.g., phenylthio), a heterocyclic group (e.g., pyridyl, triazyl), an acyl group (e.g., acetyl, propionyl, butylyl, valeryl), a sulfonyl group (e.g., methylsulfonyl, phenylsulfontl), an acylamino group, sulfonylamino group, an acyloxy group (e.g., acetoxy benzoxy), carboxy, cyano, a sulfo group, or an amino group. Of these groups are preferred an aryl group, a heterocyclic group, an alkenyl group and cyano group.

The biimidazolyl compounds can synthesized in accordance with the methods described in U.S. Pat. No. 3,734,733 and British Patent 1,271,177. Preferred Examples thereof are shown below.

| | $R_{21}$ | $R_{22}$ | $R_{23}$ |
|---|---|---|---|
| | 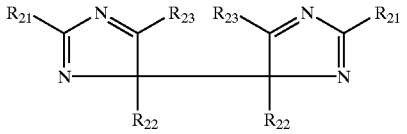 | | |
| Bl-1 | H | CN | H |
| Bl-2 | CN | H | CN |
| Bl-3 | $CF_3$ | H | $CF_3$ |
| Bl-4 | 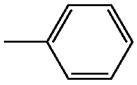 | 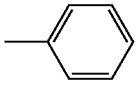 | 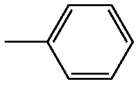 |
| Bl-5 | 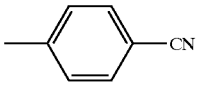 | 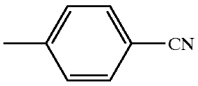 | 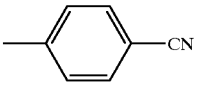 |
| Bl-6 | 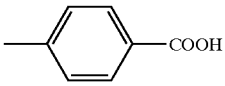 | 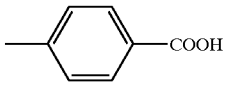 | 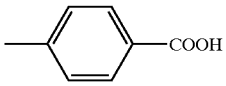 |
| Bl-7 | H | —CH═$CH_2$ | H |
| Bl-8 | 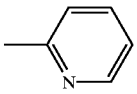 | 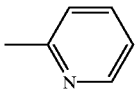 | 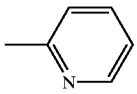 |
| Bl-9 | 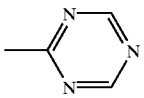 | 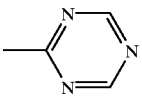 | 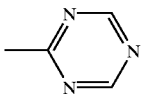 |
| | 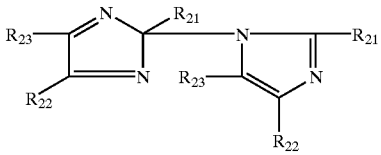 | | |
| Bl-10 | H | 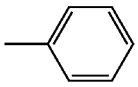 | 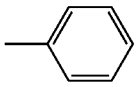 |
| Bl-11 | CN | H | H |
| Bl-12 | CN | 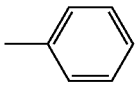 | 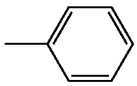 |
| Bl-13 | H | 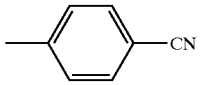 | 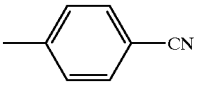 |
| Bl-14 | H | $CF_3$ | H |

-continued

| | $R_{21}$ | $R_{22}$ | $R_{23}$ |
|---|---|---|---|
| Bl-15 | H | 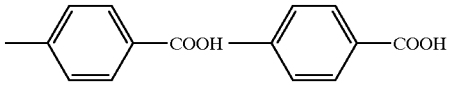 | |
| Bl-16 | H | 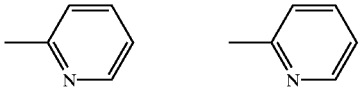 | |

Similarly preferrded compounds include a iodonium compound represented by the following formula [3]:

Formula [3]

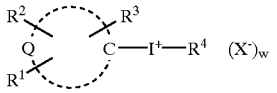

wherein Q is a group of atoms necessary to complete a 5-, 6-, or 7-membered ring, and the atoms being selected from a carbon atom, nitrogen atom, oxygen atom and sulfur atom; and $R^1$, $R^2$ and $R^3$ (,which may be the same or different) are each a hydrogen atom, an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a halogen atom, an aryloxyl (e.g., phenoxy), an alkylthio group (e.g., methylthio, butylthio), an arylthio group (e.g., phenylthio), an acyl group (e.g., acetyl, propionyl, butylyl, valeryl), a sulfonyl group (e.g., methylsulfonyl, phenylsulfonyl), an acylamino group, sulfonylamino group, an acyloxy group (e.g., acetoxy, benzoxy), carboxy, cyano, a sulfo group, or an amino group. Of these groups are preferred an aryl group, an alkenyl group and cyano group, provided that $R^1$, $R^2$ and $R^3$ may be bonded with each other to form a ring; $R^4$ is a carboxylate group such as acetate, benzoate or trifluoroacetate, or $O^-$; W is 0 or 1, provided that when $R^3$ is a sulfo group or a carboxy group, W is 0 and $R^4$ is $O^-$; $X^-$ is an anionic counter ion, including $CH_3CO_2$—, $CH_3SO_3$— and $PF_6^-$.

Of these is specifically preferred a compound represented by the following formula [4]:

formula [4]

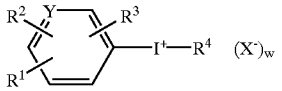

wherein $R^1$, $R^2$, $R^3$, $R^4$, $X^-$ and W are each the same as defined in formula [2]; Y is a carbon (i.e., —CH═) to form a benzene ring or a nitrogen atom (—N═) to form a pyridine ring.

The iodonium compounds described above can be synthesized in accordance with the methods described in Org. Syn., 1961 and Fieser, "Advanced Organic Chemistry" (Reinhold, N.Y., 1961).

The compound releasing a labile species other than a halogen atom, such as represented by formula [2] or [3] is incorporated preferably in an amount of 0.001 to 0.1 mol/$m^2$, and more preferably 0.005 to 0.05 mol/$m^2$. The compound may be incorporated into any component layer of the photothermographic material relating to the invention and is preferably incorporated in the vicinity of a reducing agent.

As a compound capable of deactivating a reducing agent to inhibit reduction of an organic silver salt to silver by the reducing agent are preferred compounds releasing a labile species other than a halogen atom. However, these compounds may be used in combination with a compound capable of releasing a halogen atom as a labile species.

Examples of the compound releasing an active halogen atom include a compound represented by the following formula [5]:

formula [5]

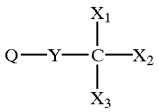

wherein Q is an aryl group or a heterocyclic group; $X_1$, $X_2$ and $X_3$ are each a hydrogen atom, a halogen atom, a haloalkyl group, an acyl group, an alkoxycarbonyl group, an aryloxycarbonyl group, a sulfonyl group, an aryl group or a heterocyclic group, provided that at least of them a halogen atom; Y is —C(═O)—, —SO— or —$SO_2$—. The aryl group represented by Q may be a monocyclic group or condensed ring group and is preferably a monocyclic or di-cyclic aryl group having 6 to 30 carbon atoms (e.g., phenyl, naphthyl), more preferably a phenyl or naphthyl group, and still more preferably a phenyl group. The heterocyclic group represented by Q is a 3- to 10-membered, saturated or unsaturated heterocyclic group containing at least one of N, O and S, which may be a monocyclic or condensed with another ring to a condensed ring.

The heterocyclic group is preferably a 5- or 6-membered unsaturated heterocyclic group, which may be condensed, more preferably a 5- or 6-membered aromatic heterocyclic group, which may be condensed, still more preferably a N-containing 5- or 6-membered aromatic heterocyclic group, which may be condensed, and optimally a 5- or 6-membered aromatic heterocyclic group containing one to four N atoms, which may be condensed. Exemplary examples of heterocyclic rings included in the heterocyclic group include imidazole, pyrazole, pyridine, pyrimidine, pyrazine, pyridazine, triazole, triazines, indole, indazole, purine, thiazole, oxadiazole, quinoline, phthalazine, naphthyridine, quinoxaline, quinazoline, cinnoline, pteridine, acrydine, phenanthroline, phenazine, tetrazole, thiazole, oxazole, benzimidazole, benzoxazole, benzthiazole, indolenine and tetrazaindene. Of these are preferred imidazole, pyridine, pyrimidine, pyrazine, pyridazine, triazole, triazines, thiadiazole, oxadiazole, quinoline, phthalazine, naphthylizine, quinoxaline, quinazoline, cinnoline, tetrazole, thiazole, oxazole, benzimidazole, and tetrazaindene; more preferably imidazole, pyrimidine, pyridine, pyrazine, pyridazine, triazole, triazines, thiadiazole, quinoline, phthalazine, naphthyridine, quinoxaline, quinazoline, cinnoline, tetrazole, thiazole, benzimidazole, and benzthiazole; and still more preferably pyridine, thiazole, quinoline and benzthiazole.

The aryl group or heterocyclic group represented by Q may be substituted by a substituent, in addition to —Y—C ($X_1$) ($X_2$) ($X_3$) Preferred examples of the substituent include an alkyl group, an alkenyl group, an aryl group, an alkoxyl group, an aryloxyl group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, phosphoramido group, a halogen atom, cyano group, sulfo group, carboxy group, nitro group and heterocyclic group. Of these are preferred an alkyl group, an aryl group, an alkoxyl group, an aryloxyl group, an acyl group, an acylamino group, an aryloxyl group, acyl group, an acylamino group, an alkoxycarbonyl group, an aryloxycarbonylamino group, a sulfonylamino group, a sulfamoyl group, a carbamoyl group, a ureido group, phosphoramido group, a halogen atom, cyano group, nitro group, and a heterocyclic group; and more preferably an alkyl group, an aryl group, an alkoxyl group, an aryloxyl group, an acyl group, an acylamino group, a sulfonylamino group, a sulfamoyl group, a carbamoyl group, a halogen group, cyano group, nitro group and a heterocyclic group; and still more preferably an alkyl group, an aryl group and a halogen atom. $X_1$, $X_2$ and $X_3$ are preferably a halogen atom, a haloalkyl group, an acyl group, an alkoxycarbonyl group, an aryloxycarbonyl group, a carbamoyl group, a sulfamoyl group, a sulfonyl group, and a heterocyclic group, more preferably a halogen atom, a haloalkyl group, an acyl group, an alkoxycarbonyl group, an aryloxycarbonyl group, and a sulfonyl group; and still more preferably a halogen atom and trihalomethyl group; and most preferably a halogen atom. Of halogen atoms are preferably chlorine atom, bromine and iodine atom, and more preferably chlorine atom and bromine atom, and still more preferably bromine atom. Y is —C(=O)—, —SO—, and —$SO_2$—, and preferably —$SO_2$—.

The amount of this compound to be incorporated is preferably within the range in which an increase of printed-out silver caused by formation of silver halide becomes substantially no problem, more preferably not more than 150% by weight and still more preferably not more than 100% by weight, based on the compound releasing no active halogen atom.

Further, in addition to the foregoing compounds, compounds commonly known as an antifoggant may be incorporated in the photothermographic imaging material used in the invention. In such a case, the compounds may be those which form a labile species similarly to the foregoing compounds or those which are different in antifogging mechanism. Examples thereof include compounds described in U.S. Pat. Nos. 3,589,903, 4,546,075 and 4,452,885; JP-A No. 59-57234; U.S. Pat. Nos. 3,874,946 and 4,756,999; and JP-A Nos. 9-288328 and 9-90550. Further, other antifoggants include, for example, compounds described in U.S. Pat. No. 5,028,523 and European patent Nos. 600,587, 605,981 and 631,176.

Reducing agents are incorporated into the photothermographic material of the present invention.

Examples of suitable reducing agents are described in U.S. Pat. Nos. 3,770,448, 3,773,512, and 3,593,863, and Research Disclosure Items 17029 and 29963, and an optimum reducing agent can be used by the selection from those commonly known in the art. In cases where fatty acid silver salts are used as an organic silver salt, polyphenols in which at least two phenyl groups are linked through an alkylene group or a sulfur atom and specifically, bisphenols in which two phenyl groups which are substituted, at the position adjacent to the hydroxy group-substituted position, with at least an alkyl group (e.g., methyl, ethyl, propyl, t-butyl, cyclohexyl, etc.) or an acyl group (e.g., acetyl, propionyl, etc.) are linked through an alkylene group or a sulfur atom. For example, the compound represented by the following formula (A) is preferred:

formula (A)

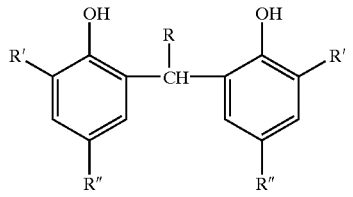

wherein R represents a hydrogen atom or an alkyl group having from 1 to 10 carbon atoms (for example, isopropyl, —$C_4H_9$, 2,4,4-trimethylpentyl), and R' and R" each represent an alkyl group having from 1 to 5 carbon atoms (for example, methyl, ethyl, t-butyl).

In addition to the foregoing compounds, examples of the reducing agents include polyphenol compounds described in U.S. Pat. No. 3.589,903 and 4,021,249; British patent No. 1,486,148; JP-A Nos. 51-51933, 50-36110, 50-116023 and 52-84727; JP-B No. 51-35727 (hereinafter, the term, JP-B means a published Japanese Patent); bisnaphthols described in U.S. Pat. No. 3,672,904, such as 2,2'-dihydroxy-1,1'-binaphthyl and 6,6'-dibromo-2,2'-dihydoxy-1,1'-binaphthyl; sulfonamidophenols and sulfonamidonaphthols described in U.S. Pat. No. 3,801,321, such as 4-benzenesulfonamidophenol, 2-benzenesulfonamidophenol, 2,6-dichloro-4-benzenesulfonamidophenol and 4-benzenesulfonamidonaphthol.

The amount of a reducing agent to be used, such as the compound represented by formula (A) is preferably $1\times10^{-2}$ to 10 mol and more preferably $1.5\times10^{-2}$ to 1.5 mol per mol silver.

The amount of the reducing agent used in the photothermographic imaging material is variable depending on the kind of an organic silver salt or reducing agent and is usually 0.05 to 10 mol, and preferably 0.1 to 3 mol per mol of organic silver salt. Two or more reducing agents may be used in combination, in an amount within the foregoing range. Addition of the reducing agent to a light sensitive emulsion comprising a light sensitive silver halide, organic silver salt grains and a solvent immediately before coating the emulsion is often preferred, thereby minimizing variation in photographic performance during standing.

Light sensitive silver halide grains used in the invention are preferably subjected to spectral sensitization by allowing a spectral sensitizing dye to adsorb to the grains. Examples of the spectral sensitizing dye include cyanine, merocyanine, complex cyanine, complex merocyanine, holo-polar cyanine, styryl, hemicyanine, oxonol and hemioxonol dyes, as described in JP-A Nos. 63-159841, 60-140335, 63-231437, 63-259651, 63-304242, 63-15245; U.S. Pat.

Nos. 4,639,414, 4,740,455, 4,741,966, 4,751,175 and 4,835,096. Usable sensitizing dyes are also described in Research Disclosure (hereinafter, also denoted as RD) 17643, page 23, sect. IV-A (December, 1978), and ibid 18431, page 437, sect. X (August, 1978). It is preferred to use sensitizing dyes exhibiting spectral sensitivity suitable for spectral characteristics of light sources of various laser imagers or scanners. Examples thereof include compounds described in JP-A Nos. 9-34078, 9-54409 and 9-80679.

Useful cyanine dyes include, for example, cyanine dyes containing a basic nucleus, such as thiazoline, oxazoline, pyrroline, pyridine, oxazole, thiazole, selenazole and imidazole nuclei. Useful merocyanine dyes preferably contain, in addition to the foregoing nucleus, an acidic nucleus such as thiohydatoin, rhodanine, oxazolidine-dione, thiazolinedione, barbituric acid, thiazolinone, malononitrile and pyrazolone nuclei. In the invention, there are also preferably used sensitizing dyes having spectral sensitivity within the infrared region. Examples of the preferred infrared sensitizing dye include those described in U.S. Pat. Nos. 4,536,478, 4,515,888 and 4,959,294.

The infrared sensitizing dye according to the invention is preferably a dye characterized in that the dye is a long chain polymethine dye, in which a sulfonyl group is substituted on the benzene ring of the benzothiazole ring.

The infrared sensitizing dyes and spectral sensitizing dyes described above can be readily synthesized according to the methods described in F. M. Hammer, The Chemistry of Heterocyclic Compounds vol. 18, "The cyanine Dyes and Related Compounds" (A. Weissberger ed. Interscience Corp., New York, 1964).

The infrared sensitizing dyes can be added at any time after preparation of silver halide. For example, the dye can be added to a light sensitive emulsion containing silver halide grains/organic silver salt grains in the form of by dissolution in a solvent or in the form of a fine particle dispersion, so-called solid particle dispersion. Similarly to the heteroatom containing compound having adsorptivity to silver halide, after adding the dye prior to chemical sensitization and allowing it to be adsorbed onto silver halide grains, chemical sensitization is conducted, thereby preventing dispersion of chemical sensitization center specks and achieving enhanced sensitivity and minimized fogging.

These sensitizing dyes may be used alone or in combination thereof. The combined use of sensitizing dyes is often employed for the purpose of supersensitization. A supersensitizing compound, such as a dye which does not exhibit spectral sensitization or substance which does not substantially absorb visible light may be incorporated, in combination with a sensitizing dye, into the emulsion containing silver halide grains and organic silver salt grains used in photothermographic imaging materials of the invention.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula is preferred as a supersensitizer:

Ar—SM General Formula wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula:

Ar—S—S—Ar General Formula wherein Ar is the same as defined in the mercapto compound represented by the formula described earlier.

The aromatic heterocyclic rings described above may be substituted with a halogen atom (e.g., Cl, Br, I), a hydroxy group, an amino group, a carboxy group, an alkyl group (having one or more carbon atoms, and preferablyl to 4 carbon atoms) or an alkoxy group (having one or more carbon atoms, and preferablyl to 4 carbon atoms).

In addition to the foregoing supersensitizers, a compound described in Japanese Patent Application No. 2000-70296, represented by the following formula (TU) and a macrocyclic compound can also employed as a supersensitizer in the invention:

formula (I)

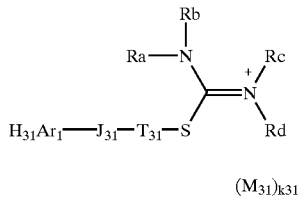

wherein $H_{31}Ar$ represent an aromatic hydrocarbon group or an aromatic heterocyclic group; $T_{31}$ represents a bivalent aliphatic hydrocarbon linkage group or a linkage group; $J_{31}$ represents a bivalent linking group containing at least one of an oxygen atom, sulfur atom and nitrogen atom, or a direct bond; Ra, Rb, Rc and Rd each represent a hydrogen atom, an acyl group, an aliphatic hydrocarbon group, an aryl group or a heterocyclic group, or Ra and Rb, Rc and Rd, Ra and Rc, or Rb and Rd combine with each other to form a nitrogen containing ring; $M_{31}$ represents an ion necessary to neutralize an intramolecular charge; and $k_{31}$ represents the number of the ion necessary to neutralize an intramolecular charge.

The bivalent, aliphatic hydrocarbon linkage group represented by $T_{31}$ include a straight-chain, branched cyclic alkylene group, an alkenylene group, an alkynylene group, each of which may be substituted by substituent group(s). The aliphatic hydrocarbon group include, for example, an alkyl group, an alkenyl group, an alkynyl group; the aryl group is monocyclic or condensed cyclic group having 6 to 20 carbon atoms. The heterocyclic group may be a saturated or unsaturated heterocyclic group. These groups each may be substituted at any position. Examples of such substituent groups include an alkyl group, an alkenyl group, an alkynyl, aryl group, an amino group, an imino group, an alkoxy group, an aryloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, an alkylthio group, arylthio group, an alkylsulfonyl or arylsulfonyl group, an alkylsulfonyl or arylsulfinyl group, an ureido group, a phosphoric acid amido group, hydroxy group, mercapto group, a halogen atom, cyano group, sulfo group, sulfino group, carboxy group, phosphono group, phosphono group, nitro group, hydroxamic acid group, hydrazino group, and a heterocyclic group. These groups may be further substituted. In cases where two or more substituent groups are contained, they may be the same or different.

Examples of a bivalent linking group containing at least one of an oxygen atom, sulfur atom and nitrogen atom, represented by $J_{31}$ include the following groups, which may be combined:

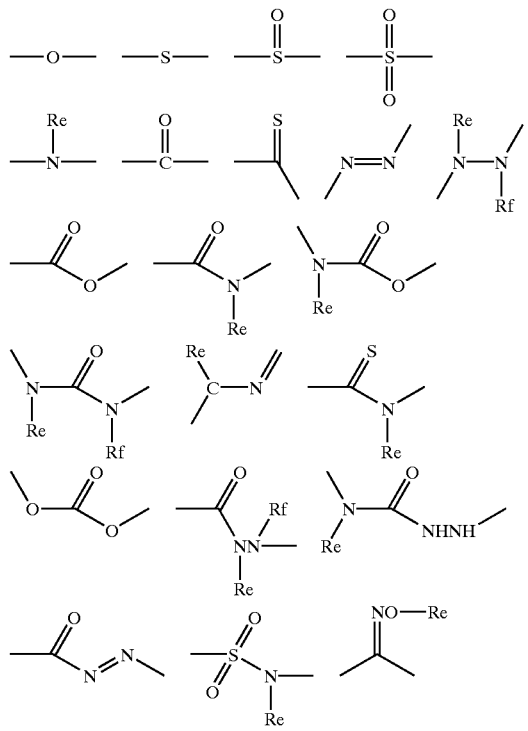

wherein Re and Rf are the same as defined in Ra through Rd.

The aromatic hydrocarbon group represented by $ArH_{31}$ is a monocyclic or condensed aryl group (preferably having 6 to 30 carbon atoms, and more preferably 6 to 20 carbon atoms). Examples thereof include phenyl and naphthyl, and phenyl is preferred. The aromatic heterocyclic group represented by $ArH_{31}$ is a 5- to 10-membered unsaturated heterocyclic group containing at least one of N, O and S, which may be monocyclic or condensed with other ring. A heterocyclic ring of the heterocyclic group is preferably a 5- or 6-membered aromatic heterocyclic ring or its benzo-condensed ring, more preferably a nitrogen-containing, 5- or 6-membered aromatic heterocyclic ring or its benzo-condensed ring, and still more preferably one or two nitrogen-containing, 5- or 6-membered aromatic heterocyclic ring or its benzo-condensed ring.

The aromatic hydrocarbon group and aromatic heterocyclic group represented by $ArH_{31}$ may be substituted. The substituent group is the same as the substituent groups defined in $T_{31}$. The substituent group may be further substituted, and plural substituting group may be the same or different. Further, the group represented by $ArH_{31}$ is preferably an aromatic heterocyclic group.

The aliphatic hydrocarbon group, aryl group and heterocyclic group represented by Ra, Rb, Rc, Rd, Re and Rf are the same as defined in $T_{31}$. The acyl group represented by Ra, Rb, Rc, Rd, Re and Rf includes an aliphatic or aromatic one having 1 to 12 carbon atoms, such as acetyl, benzoyl, formyl, and pivaloyl. The nitrogen containing heterocyclic group formed by combination of Ra and Rb, Rc and Rd, Ra and Rc, or Rb and Rd includes a 3- to 10-membered , saturated or unsaturated heterocyclic ring (e.g., ring groups such as piperidine ring, piperazine ring, acridine ring, pyrrolidine ring, pyrrol ring and morpholine ring).

Examples of acid anions used as the ion necessary to neutralize an intramolecular charge, represented by $M_{31}$ include a halide ion (e.g., chloride ion, bromide ion, iodide ion, etc.), p-toluenesulfonate ion, perchlorate ion, tetrafluorobarate ion, sulfate ion, methylsulfate ion, ethylsulfate ion, methansufonic acid ion and trifluoromethanesulfonic acid ion.

The supersensitizer is incorporated into the emulsion layer containing an organic silver salt and silver halide grains, preferably in an amount of 0.001 to 1.0 mol, and more preferably 0.01 to 0.5 mol per mol of silver.

The silver-saving agent used in the invention refers to a compound capable of reducing the silver amount necessary to obtain a prescribed silver density. The action mechanism for the reducing function has been variously supposed and compounds having a function of enhancing covering power of developed silver are preferred. Herein the covering power of developed silver refers to an optical density per unit amount of silver.

Examples of the preferred silver-saving agent include hydrazine derivative compounds represented by the following formula [H], vinyl compounds represented by formula (G) and quaternary onium compounds represented by formula (P):

formula [H]

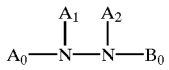

formula (G)

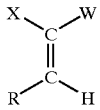

formula (P)

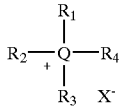

In formula [H], $A_0$ is an aliphatic group, aromatic group, heterocyclic group, each of which may be substituted, or —Go—Do group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, —C(=$NG_1D_1$)—, —SO—, —$SO_2$— or —P (O) ($G_1D_1$)— group, in which $G_1$ is a bond, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is a hydrogen atom, an aliphatic group, aromatic group, heterocyclic group, amino group, alkoxy group, aryloxy group, alkylthio group or arylthio group. $D_0$ is preferably a hydrogen atom, an alkyl group, an alkoxy group or an amino group.

In formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfo-oxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ is preferably a monocyclic or condensed-polycyclic one containing at least one hetero-atom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring. The aromatic group, heterocyclic group or —$G_0$—$D_0$ group represented by $A_0$ each may be substituted. Specifically preferred $A_0$ is an aryl group or —$G_0$—$D_0$ group.

$A_0$ contains preferably a non-diffusible group or a group for promoting adsorption to silver halide. As the non-diffusible group is preferable a ballast group used in immobile photographic additives such as a coupler. The ballast group includes an alkyl group, alkenyl group, alkynyl group, alkoxy group, phenyl group, phenoxy group and alkylphenoxy group, each of which has 8 or more carbon atoms and is photographically inert.

The group for promoting adsorption to silver halide includes a thioureido group, thiourethane, mercapto group, thioether group, thione group, heterocyclic group, thioamido group, mercapto-heterocyclic group or a adsorption group as described in JP A 64-90439.

The compounds of formula (H) can be readily synthesized in accordance with methods known in the art, as described in, for example, U.S. Pat. Nos. 5,467,738 and 5,496,695.

Furthermore, preferred hydrazine derivatives include compounds H-1 through H-29 described in U.S. Pat. No. 5,545,505, col. 11 to col. 20; and compounds 1 to 12 described in U.S. Pat. 5,464,738, col. 9 to col. 11. These hydrazine derivatives can be synthesized in accordance with commonly known methods.

In formula (G), X and R may be either cis-form or trans-form. The structure of its exemplary compounds is also similarly included.

In formula (G), X is an electron-with drawing group; W is a hydrogen atom, an alkyl group, alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfinyl group, a thiosulfinyl group, a sufinamoyl group, a phosphoryl group, nitro group, an imino group, a carbonylimino group, a N-sulfonylimino group, a dicyanoethylene group, an ammonium group, a sulfonium group, a phosphonium group, pyrylium group, or an inmonium group.

R is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxy or mercapto group (e.g., sodium salt, potassium salt, silver salt, etc.), an amino group, a cyclic amino group (e.g., pyrrolidine), an acylamino group, anoxycarbonylamino group, a heterocyclic group (5- or 6-membered nitrogen containing heterocyclic group such as benztriazolyl, imidazolyl, triazolyl, or tetrazolyl), a ureido group, or a sulfonamido group. X and W, or X and R may combine together with each other to form a ring. Examples of the ring formed by X and W include pyrazolone, pyrazolidinone, cyclopentadione, β-ketolactone, and β-ketolactam.

In formula (G), the electron-withdrawing group represented by x refers to a substituent group exhibiting a negative Hammett's substituent constant σp. Examples thereof include a substituted alkyl group (e.g., halogen-substituted alkyl, etc.), a substituted alkenyl group (e.g., cyanoalkenyl, etc.), a substituted or unsubstituted alkynyl group (e.g., trifluoromethylacetylenyl, cyanoacetylenyl, etc.), a substituted or unsubstituted heterocyclic group (e.g., pyridyl, triazyl, benzoxazolyl, etc.), a halogen atom, an acyl group (e.g., acetyl, trifluoroacetyl, formyl, etc.), thioacetyl group (e.g., thioacetyl, thioformyl, etc.), an oxalyl group (e.g., methyloxalyl, etc.), an oxyoxalyl group (e.g., ethoxalyl, etc.), a thiooxalyl group (e.g., ethylthiooxalyl, etc.), an oxamoyl group (e.g., methyloxamoyl, etc.), an oxycarbonyl group (e.g., ethoxycarbonyl, etc.), carboxy group, a thiocarbonyl group (e.g., ethylthiocarbonyl, etc.), a carbamoyl group, a thiocarbamoyl group, a sulfonyl group, a sulfinyl group, an oxysulfonyl group (e.g., ethoxysulfonyl), a thiosulfonyl group (e.g., ethylthiosulfonyl, etc.), a sulfamoyl group, an oxysulfinyl group (e.g., methoxysulfinyl, etc.), a thiosulfinyl (e.g., methylthiosulfinyl, etc.), a sulfinamoyl group, phosphoryl group, a nitro group, an imino group, N-carbonylimino group (e.g., N-acetylimino, etc.), a N-sulfonylimino group (e.g., N-methanesufonylimono, etc.), a dicynoethylene group, an ammonium group, a sulfonnium group, a phophonium group, pyrilium group and inmonium group, and further including a group of a heterocyclic ring formed by an ammonium group, sulfonium group, phosphonium group or immonium group, of these group, groups exhibiting σp of 0.3 or more are specifically preferred.

Examples of the alkyl group represented by W include methyl, ethyl and trifluoromethyl; examples of the alkenyl include vinyl, halogen-substituted vinyl and cyanovinyl; examples of the aryl group include nitrophenyl, cyanophenyl, and pentafluorophenyl; and examples of the heterocyclic group include pyridyl, pyrimidyl, triazinyl, succinimido, tetrazolyl, triazolyl, imidazolyl, and benzoxazolyl. The group, as W, exhibiting positive σp is preferred and the group exhibiting σp of 0.3 or more is specifically preferred.

Of the groups represented by R, a hydroxy group, a mercapto group, an alkoxy group, an alkylthio group, a halogen atom, an organic or inorganic salt of a hydroxy or mercapto group and a heterocyclic group are preferred, and a hydroxy group, a mercapto group and an organic or inorganic salt of a hydroxy or mercapto group are more preferred.

Of the groups of X and W, the group having a thioether bond is preferred.

In formula (P), Q is a nitrogen atom or a phosphorus atom; $R_1$, $R_2$, $R_3$ and $R_4$ each are a hydrogen atom or a substituent, provided that $R_1$, $R_2$, $R_3$ and $R_4$ combine together with each other to form a ring; and $X^-$ is an anion.

Examples of the substituent represented by $R_1$, $R_2$, $R_3$ and $R_4$ include an alkyl group (e.g., methyl, ethyl, propyl, butyl, hexyl, cyclohexyl), alkenyl group (e.g., allyl, butenyl), alkynyl group (e.g., propargyl, butynyl), aryl group (e.g., phenyl, naphthyl), heterocyclic group (e.g., piperidyl, piperazinyl, morpholinyl, pyridyl, furyl, thienyl, tetrahydrofuryl, tetrahydrothienyl, sulforanyl), and amino group. Examples of the ring formed by $R_1$, $R_2$, $R_3$ and $R_4$ include a piperidine ring, morpholine ring, piperazine ring, pyrimidine ring, pyrrole ring, imidazole ring, triazole ring and tetrazole ring. The group represented by $R^1$, $R_2$, $R_3$ and $R_4$ may be further substituted by a hydroxy group, alkoxy group, aryloxy group, carboxy group, sulfo group, alkyl group or aryl group. Of these, $R_1$, $R_2$, $R_3$ and $R_4$ are each preferably a hydrogen atom or an alkyl group. Examples of the anion of $X^-$ include a halide ion, sulfate ion, nitrate ion, acetate ion and p-toluenesulfonic acid ion.

The quaternary onium salt compounds described above can be readily synthesized according to the methods commonly known in the art. For example, the tetrazolium compounds described above may be referred to Chemical Review 55, page 335–483.

Binders suitable for photothermographic materials are transparent or translucent and generally colorless, including natural polymers, synthetic polymers or copolymers and film forming mediums. Exemplary examples thereof include gelatin, gum Arabic, polyvinyl alcohol, hydroxyethyl cellulose, cellulose acetate, cellulose acetate butyrate, polyvinyl pyrrolidine, casein, starch, polyacrylic acid, poly (methyl methacrylate), poly(methylmethacrylic acid), polyvinyl chloride, polymethacrylic acid, copoly(styrene-anhydrous maleic acid), copoly(styrene-acrylonitrile), copoly(styrene-butadiene9, polyvinyl acetals (e.g., polyvinyl formal, polyvinyl butyral), polyesters, polyurethanes, phenoxy resin, polyvinylidene chloride, polyepoxides, polycarbonates, polyvinyl acetate, cellulose esters, and polyamides, these of which may be hydrophilic or hydrophobic.

Of these, polyvinyl acetals are preferred as a binder used for the light-sensitive layer of photothermographic materials, and polyvinyl acetal is specifically preferred binder. Further, for a light insensitive layer such as an over-coating layer or a sublayer, specifically, a protective layer or a back coating layer are preferred cellulose esters exhibiting a relatively high softening temperature, such as triacetyl cellulose and cellulose acetate-butyrate. The foregoing binders may optionally be used in combination.

The binder is used in an amount within the range effective to function as a binder. The effective range can be readily determined by one skilled in the art. As a measure to hold an organic silver salt in the light sensitive layer, the ratio by weight of a binder to an organic silver salt is preferably 15:1 to 1:2, and more preferably 8:1 to 1:1. Thus, the amount of a binder in the light sensitive elayer is preferably 1.5 to 6 $g/m^2$, and more preferably 1.7 to 5 $g/m^2$. The amount of less than 1.5 $g/m^2$ results in an increase in unexposed areas, leading to levels unacceptable in practical use.

In the invention, the light-sensitive layer comprises at least two layers, wherein a glass transition temperature of a binder contained in the lower light-sensitive layer is higher than that of a binder contained in the upper light-sensitive layer (in which the lower light-sensitive layer is located closer to the support than the upper light-sensitive layer).

The binder preferably exhibits a glass transition point (Tg) of 70 to 105° C. The use of such a binder prevents softening of the layer, due to an organic acid and raises the thermal transition point temperature, thereby resulting marked effects in prevention of abrasion marks. The use of a binder exhibiting a glass transition point of less than 70° C. lowers the thermal transition point and desired physical property values including abrasion mark cannot be achieved. Further, the use of a binder exhibiting a glass transition point higher than 105° C. results in markedly lowered physical properties.

There can be employed commonly known polymeric compounds as a binder. The glass transition point is preferably 70 to 105° C.; the number average molecular weight is preferably 1,000 to 1,000,000, and more preferably 10,000 to 500,000; and the degree of polymerization is preferably 50 to 1000. Examples thereof include compounds of a polymer or copolymer containing ethylenically unsaturated monomers as a constituting unit, such as vinyl chloride, vinyl acetate, vinyl alcohol, maleic acid, acrylic acid, acrylic acid ester, vinylidene chloride, acrylonitrile, methacrylic acid, methacrylic acid ester, styrene, butadiene, ethylene, vinyl butyral, vinyl acetal and vinyl ether; polyurethane resin, and various kinds of rubber resin. In addition thereto, phenol resin, epoxy resin, polyurethane thermally hardening type resin, urea resin, melamine resin, alkyd resin, formaldehyde resin, silicone resin, epoxy-polyamide resin, and polyester resin are also usable. These resins are detailed in "Plastic Handbook" published by Asakura-shoten. The foregoing polymeric compounds are not specifically limited and there is usable any one having a glass transition point (Tg) of 70 to 105° C., including homopolymers and copolymers.

Examples of polymer containing an ethylenically unsaturated monomer as a constituting unit and its copolymer include acrylic acid alkyl esters, acrylic acid aryl esters, methacrylic acid alkyl esters, methacrylic acid aryl esters, cyanoacrylic acid alkyl esters, and cyanoacrylic acid aryl esters, in which the alkyl or aryl group may be substituted. Examples of substituent groups include methyl, ethyl, n-propyl, isopropyl, n-butyl, isobutyl, sec-butyl, tert-butyl, amyl, hexyl, cyclohexyl, benzyl, chlorobenzyl, octyl, stearyl, sulfopropyl, N-ethyl-phenylethyl, 2-(3-phenylpropyloxy)ethyl, dimethylaminophenoxyethyl, furfuryl, tetrahydrofurfuryl, phenyl, cresyl, naphthyl, 2-hydroxyethyl, 4-hydroxybutyl, triethylene glycol, dipropylene glycol, 2-methoxyethyl, 3-methoxybutyl, 2-aetoxyethyl, 2-acetoxyacetoxyethyl, 2-ethoxyethyl, 2-isopropoxy, 2-butoxyethyl, 2-(2-methoxy)ethyl, 2-(2-ethoxyethoxy)ethyl, 2-(2-butoxyethoxy)ethyl, 2-diphenylphosphorylethyl, (ω-methoxyethylene glycol (addition mole number n=6)allyl, and a dimethylaminoethyl chloride salt. In addition, the following monomers are also usable, including vinyl esters such as vinyl acetate, vinyl propionate, vinyl butyrate, vinyl isobutyrate, vinyl caproate, vinyl chloroacetate, vinyl methoxyacetate, vinyl phenylacetate, vinyl benzoate, and vinyl salicylate; N-substituted acrylamides, N-substituted methacrylamides, acrylamides and methacrylamides, in which N-substituting groups include, for example, methyl, ethyl, propyl, butyl, tert-butyl, cyclohexyl, benzyl, hydroxymethyl, methoxyethyl, dimethylaminoethyl, phenyl, dimethyl, diethyl, β-cyanoethyl, N-(2-acetoacetoxyethyl) and diacetone; olefins such as dicyclopentadiene, ethylene, propylene, 1-butene, 1-pentene, vinyl chloride, vinylidene chloride, isoprene, chloprene, butadiene, and 2,3-dimethylbutadiene; styrenes such as methylstyrene, dimethylstyrene, trimethylstyrene, ethylstyrene, isopropylstyrene, tert-butylstyrene, chloromethylstyrene, methoxystyrene, acetoxystyrene, chlorostyrene, dichlorostyrene, bromostyrene, and methyl vinylbenzoate; vinyl ethers such as methyl vinyl ether, butyl vinyl ether, hexyl vinyl ether, methoxyethyl vinyl ether, and dimethylaminoethyl vinyl ether; N-substituted maleimides, in which N-substituting groups include, for example, methyl, ethyl, propyl, butyl, tert-butyl, cyclohexyl, benzyl, n-dodecyl, phenyl, 2-methylphenyl, 2,6-diethylphenyland 2-chlorophenyl; and others such as butyl crotonate, hexyl crotonate, dimethylitaconate, dibutyl itaconate, diethyl maleate, dimetyl maleate, dibutyl maleate, diethyl fumarate, dimethyl fumarate, dibutyl fumarate, methyl vinyl ketone, phenyl vinyl ketone, methoxy ethyl ketone, glycidyl acrylate, glycidyl methacrylate, N-vinyl oxazolidone, N-vinyl pyrrolidone, acrylonitrile, methacrylonitrile, methylene malonitrile, and vinylidene chloride.

Of these polymer compounds are preferred methacrylic acid alkyl esters, methacrylic acid aryl esters and styrenes. Specifically, polymer compounds containing an acetal group are preferred, which are superior in miscibility with organic acids produced, preventing softening of the layer.

In the invention, the binder is preferably polyvinyl acetal, which substantially has an acetoacetal structure, including, for example, polyvinyl acetal described in U.S. Pat. Nos. 2,358,836, 3,003,879 and 2,828,204; and British Patent No. 771,155.

The polymer compound containing an acetal group is preferably represented by the following formula (V):

formula (V)

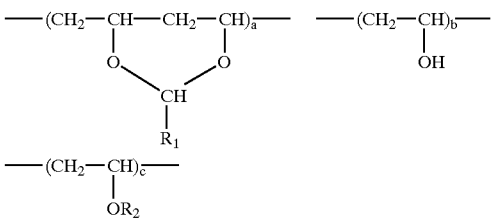

wherein $R_1$ is an unsubstituted alkyl group, a substituted alkyl group, an unsubstituted aryl group, and a substituted aryl group; $R_2$ is an unsubstituted alkyl group, a substituted alkyl group, an unsubstituted aryl group, a substituted aryl group, —$COR_3$ or —$CONHR_3$, in which $R_3$ is the same as defined in $R_1$.

The unsubstituted alkyl group represented by $R_1$, $R_2$ and $R_3$ is preferably one having 1 to 20 carbon atoms, and more preferably 1 to 6 carbon atoms, which may be straight chain or branched, and preferably straight chain. Examples of such an unsubstituted alkyl group include methyl, ethyl, n-propyl, isopropyl, n-butyl, isobutyl, t-butyl, n-amyl, t-amyl, n-hexyl, cyclohexyl, n-heptyl, n-octyl, t-octyl, 2-ethylhexyl, n-nonyl, n-decyl, n-dodecyl, and n-octadecyl. Specifically, methyl or propyl group is preferred.

The unsubstituted aryl group is preferably one having 6 to 20 carbon atoms, such as phenyl or naphthyl. Examples of a group capable of being substituted on the alkyl or aryl group include an alkyl group (e.g., methyl, n-propyl, t-amyl, t-octyl, n-nonyl, dodecyl, etc.), aryl group (e.g., phenyl), nitro group, hydroxy group, cyano group, sulfo group, alkoxy group (e.g., methoxy), aryloxy group (e.g., phenoxy), acyloxy group (e.g., acetoxy), acylamino group (e.g., acetylamino), sulfonamido group (e.g., methanesulfonamido), sulfamoyl group (e.g., methylsufamoyl9, halogen atom (e.g., fluorine, chlorine, bromine atoms), carboxy group, carbamoyl group (e.g., methylcarbamoyl), alkoxycarbonyl group (e.g., methoxycarbonyl), and sulfonyl group (e.g., methylsufonyl). In cases where two or more substituent groups are contained, the substituent groups may be the same or different. The total number of carbon atoms of the substituted alkyl group is preferably 1 to 20, and that of the substituted aryl group is preferably 6 to 20.

$R_2$ is preferably —$COR_3$ (in which $R_3$ is an alkyl or aryl group) or —$CONHR_3$ (in which $R_3$ is an aryl group); a, b and c each are the weight of respective repeating units, expressed in terms of mol %, and a is 40 to 86 mol %, b is 0 to 30 mol % and c is 0 to 60 mol %, provided that a+b+c=100 mol %, a is preferably 50 to 86 mol %, b is preferably 5 to 25 mol % and c is preferably 0 to 40 mol %. The respective repeating units having composition ratio, a, b and c may be the same or different.

Polyurethane resins having commonly known structures are usable in the invention, such as polyester-polyurethane, polyether-polyurethane, polyether-polyester-polyurethanepolycarbonate-polyurethane, polyester-polycarbonate-polyurethane, and polycaprolactone-polyurethane. In the foregoing polyurethanes, at least one polar group selected from —COOM, —$SO_3M$, —$OSO_3M$, —P═O$(OM)_2$, —O—P═$(OM)_2$ (in which M is a hydrogen atom or an alkali metal salt), —$NR_2$, —$N^+R_2$ (in which $R_2$ is a hydrocarbon group), epoxy group, —SH, and —CN is preferably introduced in copolymerization or addition reaction. Such a polar group is preferably contained in an amount of $10^{-8}$ to $10^{-1}$ mol/g, and more preferably $10^{-6}$ to $10^{-2}$ mol/g. In addition to the polar group, it is preferred to contain at least one OH group on the end of a polyurethane molecule, i.e., at least two Oh groups in total. The OH group is capable of reacting with a polyisocyanate as a hardening agent to form a three-dimensional network structure so that the more is contained in the molecule, the more preferred. Specifically, the OH group on the molecular end, which exhibits relatively high reactivity is preferred. Polyurethane having at least three OH groups (and preferably at least four OH groups) on the molecular end is preferred. Specifically, polyurethane exhibiting a glass transition point of 70 to 105° C., a rupture elongation of 100 to 2000% and a rupture stress of 0.5 to 100 N/$mm^2$ is preferred.

Polymer compounds represented by the foregoing formula (V) can be synthesized in accordance with commonly known methods, as described, for example, in "Vinyl Acetate Resin" edited by Ichiro Sakurada (KOBUNSHIKAGAKU KANKOKAI, 1962). Exemplary syntheses are shown below, but are by no means limited to these examples.

Synthesis 1: Synthesis of P-1

To 180 g of pure water was added 20 g of polyvinyl alcohol (GOSENOL GH18, available from NIPPON GOSEI Co., Ltd.) to prepare an aqueous 10 wt % polyvinyl alcohol dispersion. After polyvinyl alcohol was dissolved by raising the temperature is raised to 95° C., the solution was cooled to 75° C. to obtain an aqueous polyvinyl alcohol solution. To the aqueous polyvinyl alcohol solution was added 1.6 g of 10 wt % hydrochloric acid as an acid catalyst (which was denoted as dropping solution A). Then, 11.5 g of a mixture of butylaldehyde and acetoaldehyde in a molar ratio of 4:6 was prepared (which was denoted as dropping solution B). To 1000 ml four-necked flask provided with a cooling tube and a stirring apparatus, 100 ml pure water was added and strongly stirred with heating to 85° C. Using a dropping funnel maintained at 75° C., dropping solutions A and B were simultaneously dropwise added in 2 hrs., with stirring. The reaction was carried out, while preventing coagulation of precipitates by controlling the stirring speed. After completion of the dropwise addition, 7 g of 10 wt % hydrochloric acid was added thereto as an acid catalyst and stirred fir 2 hrs. at 85° C. to complete the reaction. Thereafter, the reaction mixture was cooled to 40° C. and neutralized with sodium bicarbonate. After repeating washing five times, filtered polymer product was separated and dried to obtain P-1. The thus obtained P-1 was measured with using a differential scanning calorimeter (DSC) to determine Tg and the Tg was proved to be 85° C.

Other polymer compounds, as shown in Table 1 were synthesized in a similar manner. These polymer compounds may be used singly or in a blended form of at least two thereof. The layer containing light-sensitive silver salt (preferably, light-sensitive layer) preferably contains the foregoing polymer compounds as a main binder. The main binder refers to the state in which at least 50% by weight of the total binder of the light-sensitive silver salt-containing layer is accounted for by the foregoing polymer. Accordingly, other polymer(s) may be blended within the range of less than 50% by weight of the total binder. Such polymer(s) are not specifically limited so long as a solvent capable of dissolving the foregoing polymer is used. Examples of such polymer(s) include polyvinyl acetate, polyacryl resin and polyurethane resin.

The composition of the foregoing polymers and a comparative polymer are shown below, in which Tg was determined using a differential scanning calorimeter (DSC, produced by SEIKO DENSHI KOGYO Co., Ltd.).

TABLE 1

| Polymer | Acetoacetal (mol %) | Butyral (mol %) | Acetal (mol %) | Acetyl (mol %) | Hydroxy Group (MOL %) | Tg (° C.) |
|---|---|---|---|---|---|---|
| P-1 | 6 | 4 | 73.7 | 1.7 | 24.6 | 85 |
| P-2 | 3 | 7 | 75.0 | 1.6 | 23.4 | 75 |
| P-3 | 10 | 0 | 73.6 | 1.9 | 24.5 | 110 |
| P-4 | 7 | 3 | 71.1 | 1.6 | 27.3 | 88 |
| P-5 | 10 | 0 | 73.3 | 1.9 | 24.8 | 104 |
| P-6 | 10 | 0 | 73.5 | 1.9 | 24.6 | 104 |
| P-7 | 3 | 7 | 74.4 | 1.6 | 24.0 | 75 |
| P-8 | 3 | 7 | 75.4 | 1.6 | 23.0 | 74 |
| P-9 | — | — | — | — | — | 60 |
| P-10 | — | — | — | — | — | 61 |

In Table 1, P-9 is polyvinyl butyral resin B-79 (available from SORCIA Co.) and P-10 is polyvinyl butyral resin (Eslex BL-5Z, available from Sekisui Kagaku Co., Ltd.). In cases where a coating solution to form a light sensitive layer of the photothermographic imaging material contains an aqueous-dispersed polymer latex, at least 50% by weight of a total binder content of the light sensitive layer-coating solution is preferably accounted for by the aqueous-dispersed polymer latex. Alternatively, in cases where the light sensitive layer contains a polymer latex, the polymer latex preferably accounts for at least 50% by weigh, and more preferably at least 70% by weight of a total binder content of the light sensitive layer.

Herein, the polymer latex is a water-insoluble polymeric material which is dispersed in an aqueous dispersing medium in the form of fine particles. The dispersion form thereof may be any one of a form in which a polymer is emulsified in a dispersing medium, a form of being emulsion-polymerized, being dispersed in the form of a micell and a form in which a polymer has a hydrophilic partial structure and its molecular chain is in the form of a molecular dispersion.

The mean particle size of dispersing particles is 1 to 50,000 nm, and preferably 5 to 1,000 nm. The particle size distribution thereof is not specifically limited and may be of broad size distribution or monodisperse.

The polymeric latexes used in the invention may be those having a uniform structure as well as core/shell type latexes. In this case, it is sometimes preferred that the glass transition temperature is different between the core and shell. The minimum film-forming (or tarnishing) temperature (MFT) of the polymeric latexes is preferably −30 to 90° C., and more preferably 0 to 70° C. A tarnishing aid is also called a plasticizer, which is an organic compound (conventionally, an organic solvent) capable of lowering the MFT of a polymeric latex and described in "Chemistry of Synthetic Latex" (S. Muroi, published by KOBUNSHI-KANKOKAI, 1970).

Polymers used for polymeric latexes include acryl resin, vinyl acetate resin, polyester resin, polyurethane resin, rubber type resin, vinyl chloride resin, vinylidene chloride resin, polyolefin resin and their copolymers. Polymers may be a straight-chained polymer or branched polymer, or a cross-linked polymer, including homopolymers and copolymers. The copolymer may be a random copolymer or a block copolymer. The number-averaged molecular weight of the copolymer is preferably 5,000 to 1000,000, and more preferably 10,000 to 100,000. In cases where the molecular weight is excessively small, mechanical strength of an light sensitive layer such as a lightsensitive layer is insufficient, excessively large molecular weight results in deterioration in film forming property.

The polymer latex used in the invention preferably exhibits an equlibrium moisture content at 25° C. and 60% RH (relative humidity) of 0.01 to 2%, and more preferably 0.01 to 1% by weight. The definition and measurement of the equlibrium moisture content are described, for example, in "KOBUNSHIKOGAKU-KOZA 14: KOBUNSHIZAIRYO SHIKENHO" (Polymer Engineering Series 14.: Polymer Material Test Method), edited by Kobunshi Gakkai, published by Chijin Shoin.

Using such polymer latex and and an aqueous solvent containing at least 30% water as a coating solvent, the light-sensitive layer can be coated. The foregoing equilibrium moisture content of more than 2% by weight results in deteriorated silver image tone after storage under high humid conditions. The aqueous solvent is referred to as water or water containing not more than 70% of an water-miscible organic solvent. Examples of the water-miscible organic solvent include alcohols such as methyl alcohol, ethyl alcohol, and propyl alcohol; cellosolve type such as methyl cellosolve, ethyl cellosolve, butyl cellosolve;ethyl acetate, and dimethylformamide. Further, this term, aqueous solvent is employed even in cases where a polymer is not thermodynamically dissolved and exists in the form of a dispersion.

Exemplary examples of polymer latexes used as binder include a latex of methylmethacrylate/ethylmethacrylate/methacrylic acid copolymer, a latex of methylmethacrylate/2-ethylhexylacrylate/styrene/acrylic acid copolymer, a latex of styrene/butadiene/acrylic acid copolymer, a latex of styrene/butadiene/divinylbenzene/methacrylic acid copolymer, a latex of methylmethacrylate/vinyl chloride/acrylic acid copolymer, and a latex of vinylidene chloride/ethylacrylate/acrylonitrile/methacrylic acid copolymer. These polymers may be used alone or may be blended.

Polymer latexes used in the invention may be used alone or in combination. The polymer latex preferably contains, as polymer species, 0.1 to 10% by weight of a carboxylic acid component, such as an acrylate or methacrylate component. Further, a hydrophilic polymer such as gelatin, polyvinyl alcohol, methyl cellulose, hydroxypropyl cellulose, carboxymethyl cellulose and hydroxypropylmethyl cellulose may be added within the range of not more than 50% by weight of the total binder. The hydrophilic binder is added preferably in an amount of not more than 30% by weight, based on the total binder of the light sensitive layer.

In preparation of a coating solution to form the light sensitive layer, an organic silver salt and an aqueous-dispersed polymer latex may be added in any order, i.e., either one may be added in advance or both ones may be simultaneously added, but the polymer latex is preferably added later. It is further preferred that the organic silver salt is mixed with a reducing agent prior to addition of the polymer latex. After mixing the organic silver salt and polymer latex, the coating solution is preferably maintained at a temperature of 30 to 65° C., more preferably 35 to 60° C., and still more preferably 35 to 55° C. since there are problems such that an excessively low temperature often vitiates the coat surface and an excessively high temperature results in increased fogging. To maintain such a temperature, a vessel to prepare the coating solution may be maintained a prescribed temperature. In coating a coating solution of the light sensitive layer, after mixing the organic silver salt and aqueous-dispersed polymer latex, a coating solution aged for 30 min to 24 hrs. is preferably used and a coating solution aged for 1 to 12 hrs. is more preferred. Herein, the expression "after mixing" refers to after the organic silver salt and the aqueous-dispersed polymer latex are added and additives are homogeneously dispersed.

Although it is commonly known that the use of a crosslinking agent in such a binder as described above improves layer adhesion and lessens unevenness in development, the use of the crosslinking agent is also effective in fog inhibition during storage and prevention of print-out after development.

Crosslinking agents usable in the invention include various commonly known crosslinking agents used for photographic materials, such as aldehyde type, epoxy type, vinylsulfone type, sulfone ester type, acryloyl type, carbodiimide type crosslinking agents, and silane type crosslinking agents. Of these, iosocyanate compounds, silane compounds, epoxy compounds and acid anhydrides are preferred.

Exemplary examples of the isocyanate compounds are described in JP-A 56-5535 on page 10 to 12. Specifically, an adduct of an isocyanate and an alcohol improves interlayer adhesion and exhibits enhanced ability of preventing layer-flaking, image slippage and production of bubbles. Such isocyanate compounds may be contained in any portion of the photothermographic material, for example, in the support (specifically in the case of paper support, it may be contained in the size composition), or in any layer of the light-sensitive layer side, such as a light-sensitive layer, surface protective layer, interlayer, anti-halation layer, and sublayer. The isocyanate compound may be contained in one or more of these layers. There are usable compounds having a thioisocyanate structure corresponding to isocyanate compounds described above.

Examples of the silane compound include compounds represented by general formulas (1) and (2) described in Japanese Patent Application No. 2000-077904.

The epoxy compound usable in the invention may be any one containing at least one epoxy group and is not limited with respect to the number of the epoxy group, molecular weight and other parameters. The epoxy group is preferably contained in the form of a glycidyl group through an ether bond or an imino bond in the molecule. The epoxy compound may be any one of a monomer, oligomer and polymer, in which the number of the epoxy group in the molecule is preferably 1 to 10 and more preferably 2 to 4. In cases where the epoxy compound is a polymer, it may be either one of a homopolymer and a copolymer. The number-averaged molecular weight (Mn) thereof is preferably 2,000 to 20,000. The acid anhydride used in the invention is preferably a compound containing at least an acid anhydride group represented as below:

—CO—O—CO—.

In this respect, the number of acid anhydride groups, molecular weight or other factors are not specifically limited.

The crosslinking agent is used preferably in an amount of 0.001 to 2 mol, and more preferably 0.005 to 0.5 mol per mol of solver.

Photothermographic imaging materials of the invention, which form photographic images on thermal development, comprises a reducible silver source (such as organic silver salts), light sensitive silver halide grains, a reducing agent, and optionally a color toning agent for adjusting silver image color tone, which are contained in the form of a dispersion in a binder matrix. Exemplary preferred toning agents are described in RD17029, U.S. Pat. Nos. 4,123,282, 3,994,732, 3,846,136 and, 4,021,249. Specifically preferred toning agents include phthalazinone, a combination of phthalazine, and phthalic acids or phthalic acid anhydrides. In the photothermographic material relating to the invention, the toning agent is used preferably in an amount of $10^{-4}$ to 3 mol/Ag mol, and more preferably $10^{-3}$ to 0.5 mol/Agmol.

With regard to image tone of the outputted image used for medical diagnosis, it has been supposed that more exact diagnostic observation results can be easily achieved with cold image tone. The cold image tone refers to pure black tone or bluish black tone and the warm image tone refers to a brownish black image exhibiting a warm tone.

The expression regarding to the tone, i.e., "colder tone" or "warmer tone can be determined based on a hue angle, $h_{ab}$ at a density of 1.0, as defined in JIS Z 8729. The hue angle, $h_{ab}$ can be represented as $h_{ab}=\tan^{-1}(b^*/a^*)$ obtained from a XYZ color system, or tristimulus values X, Y and Z or $X_{10}$, $Y_{10}$ and $Z_{10}$ defined in JIS Z 8701, using color coordinates a* and b* in L*a*b* color system defined in JIS Z 8729. In the invention the range of the $h_{ab}$ is $190°<h_{ab}<260°$, preferably $195°<h_{ab}<255°$, and more preferably $200°<h_{ab}<250°$.

In the present invention, a matting agent is preferably incorporated into the surface layer of the photothermographic imaging material (on the light sensitive layer side or even in cases where a light insensitive layer is provided on the opposite side of the support to the light sensitive layer). In order to minimize the image abrasion after thermal development, the matting agent is provided on the surface of a photosensitive material and the matting agent is preferably incorporated in an amount of 1 to 30% by weight of the binder.

Materials of the matting agent employed in the invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The matting agent used in the invention preferably has an average particle diameter of 0.5 to 10 $\mu$m, and more preferably of 1.0 to 8.0 μm. Furthermore, the variation coefficient of the size distribution is preferably not more than 50%, is more preferably not more than 40%, and is still more preferably not more than 30%. Addition methods of the matting agent include those in which a matting agent is previously dispersed into a coating composition and is then coated, and prior to the completion of drying, a matting agent is sprayed. When plural matting agents are added, both methods may be employed in combination.

Suitable supports used in the photothermographic imaging materials of the invention include various polymeric materials, glass, wool cloth, cotton cloth, paper, and metals (such as aluminum). Flexible sheets or roll-convertible one are preferred. Examples of preferred support used in the invention include plastic resin films such as cellulose acetate film, polyester film, polyethylene terephthalate film, polyethylene naphthalate film, polyamide film, polyimide film, cellulose triacetate film and polycarbonate film, and biaxially stretched polyethylene terephthalate (PET) film is specifically preferred. The support thickness is 50 to 300 μm, and preferably 70 to 180 μm.

To improve electrification properties of photothermographic imaging materials, metal oxides and/or conductive compounds such as conductive polymers may be incorporated into the constituent layer. These compounds may be incorporated into any layer and preferably into a sublayer, a backing layer, interlayer between the light sensitive layer and the sublayer. Conductive compounds described in U.S. Pat. No. 5,244,773, col. 14–20.

The photothermographic material of the invention comprises at least one light-sensitive layer on the support, and further thereon, preferably having a light-insensitive layer. For example, a protective layer is provided on the light-sensitive layer. On the opposite side of the support to the light-sensitive layer, a back coating layer is preferably provided to protect the light-sensitive layer or prevent adhesion. Binders used in the protective layer or back coating layer are preferably selected from polymers which have a glass transition point higher than that of the thermally developable layer and are hard to cause abrasion or deformation, such as cellulose acetate and cellulose acetate-butylate.

It is preferred to form a filter layer on the same side as or on the opposite side to the light sensitive layer or to allow a dye or pigment to be contained in the light sensitive layer to control the amount of wavelength distribution of light transmitted through the light sensitive layer of photothermographic imaging materials relating to the invention. Commonly known compounds having absorptions in various wavelength regions can used as a dye, in response to spectral sensitivity of the photothermographic material.

In cases where the photothermographic imaging material relating to the invention are applied as a image recording material using infrared light is preferred the use of squarilium dye containing a thiopyrylium nucleus (also called as thiopyrylium squarilium dye), squarilium dye containing a pyrylium nucleus (also called as pyrylium squarilium dye), thiopyrylium chroconium dye similar to squarilium dye or pyrylium chroconium. The compound containing a squarilium nucleus is a compound having a 1-cyclobutene-2-hydroxy-4one in the molecular structure and the compound containing chroconium nucleus is a compound having a 1-cyclopentene-2-hydroxy,4,5-dione in the molecular structure, in which the hydroxy group may be dissociated. Hereinafter, these dyes are collectively called a squarilium dye. Compounds described in JP-A 8-201959 are also preferably usable as a dye.

Materials used in respective constituent layers are dissolved or dispersed in solvents to prepare coating solutions, which were coated on the support and further subjected to a heating treatment to form a photothermographic material. A coating solution for the light-sensitive layer preferably contains at least 30%, and more preferably at least 50% by weight of water. The amount of solvents are not specifically limited, but the less solvent is more preferred in terms of environment protection and it is preferred that all of solvents used are water. In one preferred embodiment of the invention, plural coating solutions are simultaneously coated to form multi-layers and then subjected to a heating treatment. Thus, coating solutions for respective constituent layers (for example, light-sensitive layer, protective layer) and coating and drying are not repeated for respective layers but plural layers are simultaneously coated and dried to form respective constituent layers. The upper layer is provided before the remaining amount of total solvents in the lower layer reaches 70% or less.

Methods for simultaneously coating plural constituent layers are not specifically limited and commonly known methods, such as a bar coating method, curtain coating method, air-knife method, hopper coating method and extrusion coating method are applicable. Of these, extrusion coating, that is, pre-measuring type coating is preferred. The extrusion coating is suitable for accurate coating or organic solvent coating since no evaporation occur on the slide surface, as in a slide coating system. This coating method is applicable not only to the light-sensitive layer side but also to the case when simultaneously coating a backing layer with the sublayer.

The developing conditions for photographic materials are variable, depending on the instruments or apparatuses used, or the applied means and typically accompany heating the imagewise exposed photothermographic imaging material at an optimal high temperature. Latent images formed upon exposure are developed by heating the photothermographic material at an intermediate high temperature (ca. 80 to 200° C., and preferably 100 to 200° C.) over a period of ample time (generally, ca. 1 sec. to ca. 2 min.). Sufficiently high image densities cannot be obtained at a temperature lower than 80° C. and at a temperature higher than 200° C., the binder melts and is transferred onto the rollers, adversely affecting not only images but also transportability or the thermal processor. An oxidation reduction reaction between an organic silver salt (functioning as an oxidant) and a reducing agent is caused upon heating to form silver images. The reaction process proceeds without supplying any processing solution such as water from the exterior.

Heating instruments, apparatuses and means include typical heating means such as a hot plate, hot iron, hot roller or a heat generator employing carbon or white titanium. In the case of a photothermographic imaging material provided with a protective layer, it is preferred to thermally process while bringing the protective layer side into contact with a heating means, in terms of homogeneous-heating, heat efficiency and working property. The heating drum is preferably a metallic drum. A metallic heating drum having a thermal conductivity of 10 210 W/m·K, a specific heat of 0.2 to 1.2 kJ/kg·K, a density of 2 to 10 g/cm$^3$ and a thickness of 0.1 to 50 mm is specifically preferred. It is specifically preferred to conduct thermal development using a thermal processor provided with a heating drum, in which a silicone rubber layer is coated on the surface of the foregoing metallic heating drum. In this regard, the surface-coated silicone rubber layer having a thermal conductivity of 0.1 to 1.0 W/mK. a specific heat of 1.0 to 2.0 kJ/kg·K, a density of 0.8 to 2.0 g/cm$^3$, and a thickness of 0.05 to 5 mm is specifically preferred.

Exposure of photothermographic imaging materials desirably uses a light source suitable to the spectral sensitivity of the photothermographic materials. An infrared-sensitive photothermographic material, for example, is applicable to any light source in the infrared light region but the use of an infrared semiconductor laser (780 nm, 820 nm) is preferred in terms of being relatively high power and transparent to the photothermographic material.

In the invention, exposure is preferably conducted by laser scanning exposure and various methods are applicable to its exposure. One of the preferred embodiments is the use of a laser scanning exposure apparatus, in which scanning laser light is not exposed at an angle substantially vertical to the exposed surface of the photothermographic material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photothermographic material is scanned with laser light, the beam spot diameter on the surface of the photosensitive material is preferably not more than 200 $\mu$m, and more preferably not more than 100 $\mu$m. Thus, the smaller spot diameter preferably reduces the angle displaced from verticality of the laser incident angle. The lower limit of the beam spot diameter is 10 $\mu$m. The thus configured laser scanning exposure can reduce deterioration in image quality due to reflected light, such as occurrence of interference fringe-like unevenness.

In the second preferred embodiment of the invention, exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

In the third preferred embodiment of the invention, it is preferred to form images by scanning exposure using at least two laser beams. The image recording method using such plural laser beams is a technique used in image-writing means of a laser printer or a digital copying machine for writing images with plural lines in a single scanning to meet requirements for higher definition and higher speed, as described in JP-A 60-166916. This is a method in which laser light emitted from a light source unit is deflection-scanned with a polygon mirror and an image is formed on the photoreceptor through an fθ lens, and a laser scanning optical apparatus similar in principle to an laser imager.

In the image-writing means of laser printers and digital copying machines, image formation with laser light on the photoreceptor is conducted in such a manner that displacing one line from the image forming position of the first laser light, the second laser light forms an image from the desire of writing images with plural lines in a single scanning. Concretely, two laser light beams are close to each other at a spacing of an order of some ten $\mu$m in the sub-scanning direction on the image surface; and the pitch of the two beams in the sub-scanning direction is 63.5 $\mu$m at a printing density of 400 dpi and 42.3 $\mu$m at 600 dpi (in which the printing density is represented by "dpi", i.e., the number of dots per inch). As is distinct from such a method of displacing one resolution in the sub-scanning direction, one feature of the invention is that at least two laser beams are converged on the exposed surface at different incident angles to form images. In this case, when exposed with N laser beams, the following requirement is preferably met: when the exposure energy of a single laser beam (of a wavelength of λ nm) is represented by E, writing with N laser beam preferably meets the following requirement:

$$0.9\times E \leqq En\times N \leqq 1.1\times E$$

in which E is the exposure energy of a laser beam of a wavelength of λ nm on the exposed surface when the laser beam is singly exposed, and N laser beams each are assumed to have an identical wavelength and an identical exposure energy (En). Thereby, the exposure energy on the exposed surface can be obtained and reflection of each laser light onto the image forming layer is reduced, minimizing occurrence of an interference fringe.

In the foregoing, plural laser beams having a single wavelength are employed but lasers having different wavelengths may also be employed. In such a case, the wavelengths preferably fall within the following range:

$$(\lambda-30)<\lambda_1, \lambda_2, \ldots \lambda_n<(\lambda+30).$$

Similarly to the foregoing third embodiment, as a preferred fourth method using plural laser, occurrence of interference fringe can be prevented by using two laser lights differing in incident angle. When a light-sensitive layer containing organic silver salt and silver halide grains having an average size of not more than 0.1 $\mu$m is provided on the support having a thickness of 200 $\mu$m or less, the transmittance at the average wavelength of laser is nor more than 20% and a silver salt photothermographic material film having a contrast (γ) of 2 or more is employed, the interference fringe can be effectively prevented by selecting two lasers having incident angles (θ1, θ2) falling within the range of the following equation (1), and preferably equation (2):

$$(N+0.5-(0.5/\gamma))<(2nh/\lambda)(\cos\theta1'+\cos 2')<(N;0.5+(0.5/\gamma)) \quad (1)$$

$$(N+0.5-(0.2/\gamma))<(2nh/\lambda)(\cos\theta1'+\cos 2')<(N;0.5+(0.2/\gamma)) \quad (2)$$

where sin θ/sin θ'=n: refractive index of a recording medium (θ: θ1, θ2; θ': θ1', θ2'); h: thickness of recording medium, θ: incident angle, θ': incident angle in the interior of the recording medium.

In the first, second and third preferred embodiments of the image recording method of the invention, lasers for scanning exposure used in the invention include, for example, solid-state lasers such as ruby laser, YAG laser, and glass laser; gas lasers such as He—Ne laser, Ar laser, Kr ion laser, $CO_2$ laser, Co laser, He—Cd laser, $N_2$ laser and eximer laser; semiconductor lasers such as InGa laser, AlGaAs laser, GaAsP laser, InGaAs laser, InAsP laser, $CdSnP_2$ laser, and GSb laser; chemical lasers; and dye lasers. Of these, semiconductor lasers of wavelengths of 600 to 1200 nm are preferred in terms of maintenance and the size of the light source. When exposed onto the photothermographic imaging material in the laser imager or laser image-setter, the beam spot diameter on the exposed surface is 5 to 75 $\mu$m as a minor axis diameter and 5 to 100 $\mu$m as a major axis diameter. The laser scanning speed is set optimally for each photothermographic material, according to its sensitivity at the laser oscillation wavelength and the laser power.

It is preferred that when subjected to thermal development, the photothermographic imaging material contains an organic solvent of 5 to 100 mg/m$^2$. The organic solvent content is more preferably 100 to 500 mg/m$^2$. The solvent content within the range described above leads to a thermally developable photosensitive material with low fog density as well as high sensitivity. Examples of solvents include ketones such as acetone, isophorone, ethyl amyl ketone, methyl ethyl ketone, methyl isobutyl ketone; alcohols such as methyl alcohol, ethyl alcohol, n-propyl alcohol, isopropyl alcohol, n-butyl alcohol, isobutyl alcohol, diacetone alcohol, cyclohexanol, and benzyl alcohol; glycols such as ethylene glycol, dimethylene glycol, triethylene glycol, propylene glycol and hexylene glycol; ether alcohols such as ethylene glycol monomethyl ether, and dimethylene glycol monomethyl ether; ethers such as ethyl ether, dioxane, and isopropyl ether; esters such as ethyl acetate, butyl acetate, amyl acetate, and isopropyl acetate; hydrocarbons such as n-pentane, n-hexane, n-heptane, cyclohexene, benzene, toluene, xylene; chlorinated compounds such as chloromethyl, chloromethylene, chloroform, and dichlorobenzene; amines such as monomethylamine, dimethylamine, triethanol amine, ethylenediamine, and triethylamine; and water, formaldehyde, dimethylformaldehyde, nitromethane, pyridine, toluidine, tetrahydrofuran and acetic acid. The solvents are not to be construed as limiting these examples. These solvents may be used alone or in combination.

The solvent content in the photothermographic material can be adjusted by varying conditions such as temperature conditions at the drying stage, following the coating stage. The solvent content can be determined by means of gas chromatography under conditions suitable for detecting the solvent.

EXAMPLES

The present invention will be further described based on examples but is by no means limited to these examples.

Example 1

Preparation of a Subbed PET Photographic Support

Both surfaces of a biaxially stretched thermally fixed 175 μm PET film, available on the market, was subjected to corona discharging at 8 w/m$^2$·min. Onto one side of the film, the subbing coating composition a-1 descried below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

| Subbing Coating Composition a-1 | |
|---|---|
| Latex solution (solid 30%) of a copolymer consisting of butyl acrylate (30 weight %), t-butyl acrylate (20 weight %) styrene (25 weight %) and 2-hydroxy ethyl acrylate (25 weight %) | 270 g |
| (C-1) | 0.6 g |
| Hexamethylene-1,6-bis (ethyleneurea) | 0.8 g |
| Water to make | 1 liter |

-continued

| Subbing Coating Composition b-1 | |
|---|---|
| Latex liquid (solid portion of 30%) of a copolymer consisting of butyl acrylate (40 weight %) styrene (20 weight %) glycidyl acrylate (25 weight %) | 270 g |
| (C-1) | 0.6 g |
| Hexamethylene-1,6-bis (ethyleneurea) | 0.8 g |
| Water to make | 1 liter |

Subsequently, the surfaces of Subbing Layers A-1 and B-1 were subjected to corona discharging with 8 w/m$^2$ ·minute. Onto the Subbing Layer A-1, the upper subbing layer coating composition a-2 described below was applied so as to form a dried layer thickness of 0.8 μm, which was designated Subbing Layer A-2, while onto the Subbing Layer B-1, the upper subbing layer coating composition b-2 was applied so at to form a dried layer thickness of 0.8 μm, having a static preventing function, which was designated Subbing Upper Layer B-2.

| Upper Subbing Layer Coating Composition a-2 | |
|---|---|
| Gelatin in an amount (weight) to make | 0.4 g/m$^2$ |
| (C-1) | 0.2 g |
| (C-2) | 0.2 g |
| (C-3) | 0.1 g |
| Silica particles (av. size 3 μm) | 0.1 g |
| Water to make | 1 liter |
| **Upper Subbing Layer Coating Composition b-2** | |
| (C-4) | 60 g |
| Latex solution (solid 20% comprising) (C-5) as a substituent | 80 g |
| Ammonium sulfate | 0.5 g |
| (C-6) | 12 g |
| Polyethylene glycol (average molecular weight of 600) | 6 g |
| Water to make | 1 liter |

(C-1)

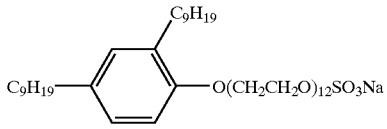

(C-2)

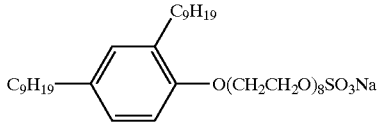

(C-3)

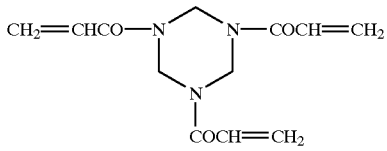

-continued (C-4)

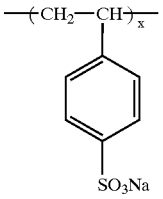

($\overline{M_n}$ is a number average molecular weight)

x:y = 75:25 (weight ratio)

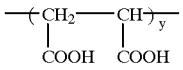

$\overline{M_n}$ =5000

(C-5)

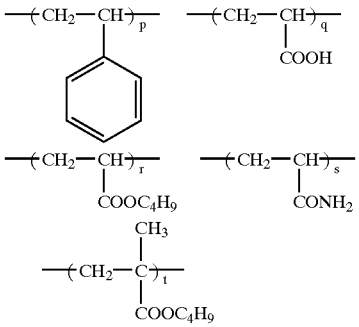

p:q:r:s:t=40:5:10:5:40 (weight ratio)

(C-6)

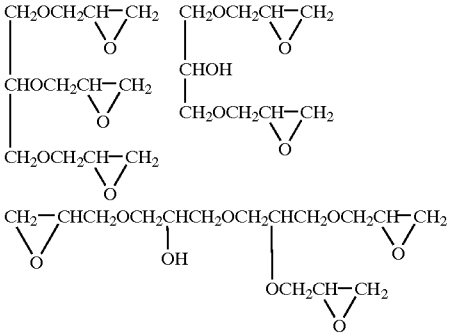

Mixture consisting of the three compounds illustrated above

Back Layer-side Coating

Back Layer Coating Solution

To 830 g of methyl ethyl ketone (MEK), 84.2 g of cellulose acetate-butyrate (CAB381-20, available from Eastman Chemical Co.) and 4.5 g of polyester resin (Vitel PE2200B, available from Bostic Corp.) were added with stirring and dissolved therein. To the resulting solution was added 0.30 g of infrared dye 1, then, 4.5 g fluorinated surfactant (Surflon KH40, available from ASAHI Glass Co. Ltd.) and 2.3 g fluorinated surfactant (Megafag F120K, available from DAINIPPON INK Co. Ltd.) which were dissolved in 43.2 g methanol, were added thereto and stirred until being dissolved. Then, 75 g of silica (Siloid 64X6000, available from W. R. Grace Corp.), which was dispersed in methyl ethyl ketone in a concentration of 1 wt % using a dissolver type homogenizer, was further added thereto with stirring to obtain a coating solution for the backing layer.

The thus prepared coating solutions were each coated on the support using an extrusion coater and dries so as to form a dry layer of 3.5 μm. Drying was conducted at a dry bulb temperature of 100° C. and a dew point of 10° C. over a period of 5 min.

Preparation of Light-Sensitive Silver Halide Emulsion A

| | |
|---|---|
| Solution A1 | |
| Phenylcarbamoyl gelatin | 88.3 g |
| Compound A* (10% methanol solution) | 10 ml |
| Potassium bromide | 0.32 g |
| Water to make | 5429 ml |
| Solution B1 | |
| 0.67 mol/l Aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| Iridium chloride (1% solution) | 0.93 ml |
| Water to make | 1982 ml |
| Solution E1 | |
| 0.4 mol/l aqueous potassium bromide solution | |
| Amount necessary to adjust silver potential | |
| Solution F1 | |
| Potassium hydroxide | 0.71 g |
| Water to make | 20 ml |
| Solution G1 | |
| Aqueous 56% acetic acid solution | 18 ml |
| Solution H1 | |
| Anhydrous sodium carbonate | 1.72 g |
| Compound (A) | |
| $HO(CH_2CH_2O)_n—(CH(CH_3)CH_2O)_{17}—CH_2CH_2O)_mH$ | |
| (m + n = 5 to 7) | |

Using a stirring mixer described in JP-B 58-58288, ¼ of solution B1, the total amount of solution C1 were added to solution A1 by the double jet addition for 4 min 45 sec. to form nucleus grain, while maintaining a temperature of 45° C. and a pAg of 8.09. After 1 min., the total amount of solution F1 was added thereto. After 6 min, ¾ of solution B1 and the total amount of solution D1 were further added by the double jet addition for 14 min 15 sec., while mainlining a temperature of 45° C. and a pAg of 8.09. After stirring for 5 min., the reaction mixture was lowered to 40° C. and solution G1 was added thereto to coagulate the resulting silver halide emulsion. Remaining 2000 ml of precipitates, the supernatant was removed and after adding 10 lit. water with stirring, the silver halide emulsion was again coagulated. Remaining 1500 ml of precipitates, the supernatant was removed and after adding 10 lit. water with stirring, the silver halide emulsion was again coagulated. Remaining 1500 ml of precipitates, the supernatant was removed and solution Hi was added. The temperature was raised to 60° C. and stirring continued for 120 min. Finally, the pH was adjusted to 5.8 and water was added there to so that the weight per mol of silver was 1161 g, and light-sensitive silver halide emulsion A was thus obtained.

It was proved that the resulting emulsion was comprised of monodisperse silver iodobromide cubic grains having an average grain size of 0.058 μm, a coefficient of variation of grain size of 12% and a [100] face ratio of 92%.

Preparation of Powdery Organic Silver Salt A

Behenic acid of 130.8 g, arachidic acid of 67.7 g, stearic acid of 43.6 g and palmitic acid of 2.3 g were dissolved in 4720 ml of water at 90° C. Then, 540.2 ml of aqueous 1.4 mol/l NaOH was added, and after further adding 6.9 ml of concentrated nitric acid, the mixture was cooled to 55° C. to obtain a fatty acid sodium salt solution. To the thus obtained fatty acid sodium salt solution, 45.3 g of light-sensitive silver halide emulsion B-3 obtained above and 450 ml of water were added and stirred for 5 min., while being maintained at 55° C. Subsequently, 760 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 μS/cm. Using a flush jet dryer (produced by Seishin Kigyo Co., Ltd.), the thus obtained cake-like organic silver salt was dried under an atmosphere of inert gas (i.e., nitrogen gas) having a volume ratio shown in Table 1, according to the operation condition of a hot air temperature at the inlet of the dryer until reached a moisture content of 0.1%. The moisture content was measured by an infrared ray aquameter.

Preparation of Pre-dispersion A

In 1457 g MEK was dissolved 14.57 g of polyvinyl butyral powder (B-79, available from Monsanto Co.) and further thereto was gradually added 500 g of powdery organic silver salt 1A to obtain pre-dispersion, while stirring by a dissolver type homogenizer (DISPERMAT Type CA-40, available from VMA-GETZMANN).

Preparation of Light-sensitive Emulsion 1

Thereafter, using a pump, the thus prepared pre-dispersion was transferred to a media type dispersion machine (DISPERMAT Type SL-C12 EX, available from VMA-GETZMANN), which was packed 1 mm Zirconia beads (TORESELAM, available from Toray Co. Ltd.) by 80%, and dispersed at a circumferential speed of 8 m/s and for 1.5 min. of a retention time with a mill to obtain light-sensitive emulsion 1A.

Preparation of Stabilizer Solution

In 4.97 g of methanol were dissolved 1.0 g of Stabilizer 1 and 0.31 g of potassium acetate to obtain stabilizer solution.

Preparation of Infrared Sensitizing Dye Solution A

In 31.3 ml of MEK were dissolved 19.2 mg of infrared sensitizing dye 1, 1.488 g of 2-chlorobenzoic acid, 2.779 g of Stabilizer 2 and 365 mg of 5-methyl-2-mercaptobenzimidazole in a dark room to obtain an infrared sensitizing dye solution 1A.

Preparation of Additive Solution a

In 110 g MEK were dissolved developer 27.98 g of 1,1-bis(2-hydroxy-3,5-dimethylphenyl)-2-methylpropane, 1.54 g of 4-methylphthalic acid and 0.48 g of the infrared dye 1 to obtain additive solution a.

Preparation of Additive Solution b

Antifoggant of 3.56 g and 3.43 g of phthalazinone were dissolved in 40.9 g of MEK to to make additive solution b.

Preparation of Additive Solution c

To 45.0 g of MEK was added 5.0 g of silver-saving agent HD-1 (vinylsulfone compound) to make additive solution c.

Preparation of Light-sensitive Layer Coating Solution A

Under inert gas atmosphere (97% nitrogen), 50 g of the light-sensitive emulsion 1 and 15.11 g MEK were maintained at 21° C. with stirring, 1000 μl of chemical sensitizer 1 (0.5% methanol solution) was added thereto and after 2 min., 390 μm of antifoggant 1 (10% methanol solution) was added and stirred for 1 hr. Further thereto, 494 μl of calcium bromide (10% methanol solution) was added and after stirring for 10 min., gold sensitizer Au-1 of 1/20 equimolar amount of the chemical sensitizer was added and stirred for 20 min. Subsequently, 167 ml of the stabilizer solution was added and after stirring for 10 min., 1.32 g of the infrared sensitizing dye solution described above was added and stirred for 1 hr. Then, the mixture was cooled to 13° C. and stirred for 30 min. Further thereto, 13.31 g of binder shown in Table 2 was added and stirred for 30 min, while maintaining the temperature at 13° C., and 1.084 g of tetrachlorophthalic acid (9.4% MEK solution) and stirred for 15 min. Then, 12.43 g of additive solution a, 10% MEK solution of Desmodur N3300 (aliphatic isocyanate, product by Movey Co.) and 4.27 g of additive solution b were successively added with stirring to obtain coating solution A of the light-sensitive layer.

Preparation of Light-sensitive Layer Coating Solution B

Under inert gas atmosphere (97% nitrogen), 50 g of the light-sensitive emulsion 1 and 15.11 g MEK were maintained at 21° C. with stirring, 1000 μl of chemical sensitizer 1 (0.5% methanol solution) was added thereto and after 2 min., 390 μm of antifoggant 1 (10% methanol solution) was added and stirred for 1 hr. Further thereto, 494 μl of calcium bromide (10% methanol solution) was added and after stirring for 10 min., gold sensitizer Au-5 of 1/20 equimolar amount of the chemical sensitizer was added and stirred for 20 min. Subsequently, 167 ml of the stabilizer solution was added and after stirring for 10 min., 1.32 g of the infrared sensitizing dye solution described above was added and stirred for 1 hr. Then, the mixture was cooled to 13° C. and stirred for 30 min. Further thereto, 13.31 g of binder shown in Table 2 was added and stirred for 30 min, while maintaining the temperature at 13° C., and 1.084 9 of tetrachlorophthalic acid (9.4% MEK solution) and stirred for 15 min. Then, 12.43 g of additive solution a, 10% MEK solution of Desmodur N3300 (aliphatic isocyanate, product by Movey Co.) and 4.27 g of additive solution b were successively added with stirring to obtain coating solution A of the light-sensitive layer.

Preparation of Matting Agent Dispersion

In 42.5 9 methyl ethyl ketone was dissolved 7.5 g of cellulose acetate-butyrate (CAB171-15, available from Eastman Chemical Co.) and then 5 g of calcium carbonate (Super-Pflex 200, available from Speciality Mineral Corp.) was added thereto and dispersed using a dissolver type homogenizer at a speed of 800 rpm over a period of 30 min. to obtain calcium carbonate dispersion.

Preparation of Coating Solution for Protective Layer

To 865 g of methyl ethyl ketone were added with stirring 96 g of cellulose acetate-butyrate (CAB171-15, available from Eastman Chemical Co.) and 4.5 g of polymethyl methacrylate (Paraloid A-21, available from Rohm & Haas Corp.). Further thereto were added and dissolved 1.5 g of vinylsulfon compound HD-1, 1.0 9 of benzotriazole and 1.0 g of fluorinated surfactant (Surflon KH40, available from ASAHI Glass Co. Ltd.). Finally, 30 g of the foregoing matting agent dispersion was added and stirred to obtain a coating composition for the surface protective layer.

Stabilizer 1

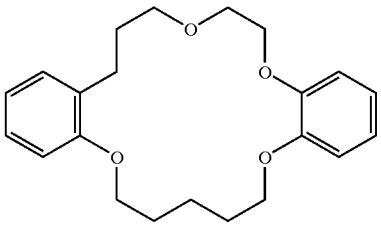

Antifoggant 1

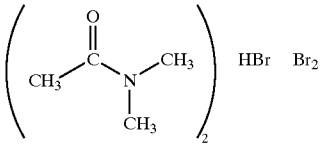

Stabilizer 2

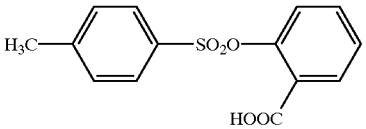

Antifoggant 2

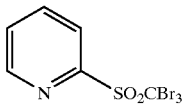

Vinylsulfone Compound (HD-1)

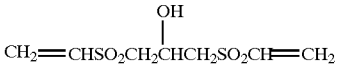

Infrared Sensitizing Dye 1

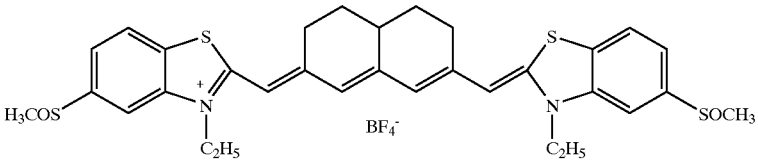

Infared dye 1

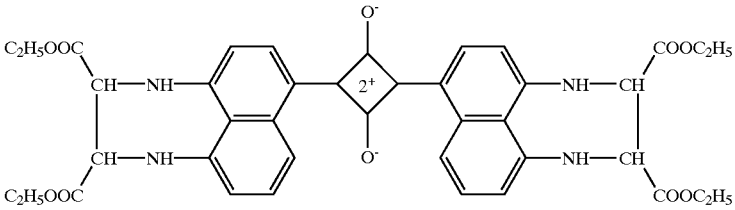

Chemical Sensitizer 1

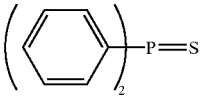

Au-1

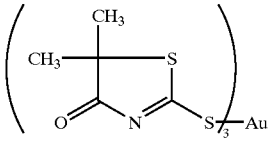

Coating of Light-sensitive Layer Side

The foregoing light-sensitive layer coating composition B for the lower layer, composition A for the upper layer and protective layer coating composition were simultaneously coated by using an extrusion coater to form two light-sensitive layers and a protective layer so that the silver coverage of the upper light-sensitive layer A and lower light-sensitive layer B was 0.7 and 0.3 g/m$^2$, respectively and dry thickness of the protective layer was 2.5 $\mu$m. Thereafter, drying was conducted using hot air at a dry-bulb temperature of 50° C. and a dew point of 10° C. over a period of 10 min. Thus, photothermographic material sample 101 was prepared.

Photothermographic material samples 102 through 110 were prepared similarly to sample 101.

Exposure, Thermal Development and Evaluation

The thus prepared photothermographic material was subjected to laser scanning exposure from the emulsion side using an exposure apparatus having a light source of 810 nm semiconductor laser of a longitudinal multi-mode, which was made by means of high frequency overlapping. In this case, exposure was conducted at 75° of an angle between the exposed surface and exposing laser light, in an exposure amount of 50 $\mu$J/m$^2$. The thus exposed photothermographic material was subjected to thermal development at 124° C. for 16 sec., while bringing the protective layer surface of the photothermographic material into contact with the heated drum surface. Exposure and thermal development were conducted in an atmosphere of 23° C. and 50% RH. The thus obtained image was subjected to densitometry using a densitometer to evaluate sensitivity and uniformity in density. Sensitivity was represented by a relative value of the reciprocal of exposure giving a density of 1.0 higher than an unexposed area density (i.e., fog density), based on the sensitivity of sample No. 101 being 100. Photothermographic material samples were also subjected to overall non-image exposure sp as to give a density of 1.0 and thermally developed similarly. The thus processed samples were evaluated with respect to uniformity in density, based on the following criteria:

5: No unevenness in density,

4: No visually observable unevenness in density,

3: Slightly observed unevenness in density but acceptable in practical use,

2: Unevenness in density was observed, possibly producing problems in diagnosis, 1: Marked unevenness in density was observed and unacceptable in practical use.

Evaluation of Image Tone

Photothermographic material samples were also allowed to stand for 10 days at 25° C. and 55% RH, and subjected to exposure and thermal development. Further, after being allowed to stand for 7 days in an atmosphere of 25° C. and 55% RH under fluorescent lamp, thermally developed samples were evaluated with respect image color tone, based on the following criteria:

5: No problem in image tone,

4: No problem in image tone for practical use,

3: Slightly yellowish tone but acceptable tone,

2: Unpleasant tone and problem in image tone

1: Marked variation in tone and unacceptable in practical use.

Measurement of Solvent Content of Film

Film samples were each measured with respect to the solvent content. Thus, sample films each were cut to an area of 46.3 $cm^2$, further finely cut to about 5 mm, contained into a specified Bayern bottle, which was closely packed with septum and aluminum cap, and set to head space sampler HP769 (available Hewlett Pachard Co.), which was connected to gas chromatography (GC) Hewlett Packard type 5971 provided with a hydrogen flame ion detector (FID). Chromatograms were obtained under the measurement conditions including a head space sampler heating temperature: 120° C. for 20 min., a GC-introducing temperature: 150° C., column: DB-624 (available from J & W co.)

temperature-increasing: 45° C. (3 min.) to 100° C. at a rate of 8°/min.

Solvents to be measure were methyl ethyl ketone and methanol. A given amount of each solvent, which was further diluted with butanol was contained into a Bayern bottle and subjected to the chromatographic measurement in a manner similar to above. Using a calibration curve prepared from the obtained chromatogram peak area, the solvent content of each film sample was determined.

As a result, it was proved that solvent contents of samples No. 101 through No. 108 fell within the range of 32 to 55 $mg/M^2$ and such contents were regarded to be substantially identical in affecting on thermal developability of photothermographic materials, substantially resulting in no effect on photographic performance.

Results are shown in Table 2.

TABLE 2

| | Light-sensitive A (Upper) | | | Light-sensitive Layer B (Lower) | | | | | | | |
|---|---|---|---|---|---|---|---|---|---|---|---|
| Sample No. | Binder | Isocyanate*1 (ml) | r'** (μm) | Binder | Isocyanate*1 (ml) | Additive Solution c (g) | r'** (μm) | Uniformity in Density | Image Tone | Sensitivity | Remark |
| 101 | P-9 | — | 1.15 | P-9 | — | — | 1.15 | 1 | 1 | 100 | Comp. |
| 102 | P-10 | 1.6 | 1.00 | P-10 | — | — | 1.13 | 2 | 1 | 95 | Comp. |
| 103 | P-10 | 1.6 | 1.00 | P-1 | 1.6 | — | 0.70 | 4 | 5 | 96 | Inv. |
| 104 | P-10 | 1.6 | 1.00 | P-2 | 1.6 | — | 0.75 | 5 | 4 | 97 | Inv. |
| 105 | P-10 | 1.6 | 1.00 | P-4 | 1.6 | — | 0.72 | 5 | 4 | 95 | Inv. |
| 106 | P-2 | 1.6 | 0.75 | P-3 | 1.6 | — | 0.40 | 5 | 5 | 98 | Inv. |
| 107 | P-1 | 1.6 | 0.70 | P-4 | 1.6 | — | 0.45 | 5 | 5 | 99 | Inv. |
| 108 | P-2 | 1.6 | 0.75 | P-3 | 3.2 | — | 0.35 | 5 | 5 | 97 | Inv. |
| 109 | P-2 | 1.6 | 0.75 | P-3 | 1.6 | 5 | 0.38 | 5 | 5 | 105 | Inv. |
| 110 | P-2 | 1.6 | 0.75 | P-3 | 1.6 | 10 | 0.35 | 5 | 5 | 103 | Inv. |

*1Aliphatic isocyanate solution (10% MEK solution)
**r, r': Mean radius of spheres of influence As apparent from Table 2, photothermographic materials according to the invention exhibited improved uniformity in density and superior image tone as well as enhanced sensitivity, compared to comparative samples.

What is claimed is:

1. A silver salt photothermographic material comprising a support having at least two light-sensitive layers provided on the support, wherein each of the light sensitive layers contains a light sensitive silver halide, a light-insensitive organic silver salt and a binder, wherein the photothermographic material exhibits a gradation of between 2.0 and 5.0 within the density region of between 0.5 and 2.0 on a photographic characteristic curve obtained when the photothermographic material is exposed to light of 50 $\mu J/cm^2$ and thermal development at 124° C. for about 16 seconds; the at least two light-sensitive layers comprise a lower layer and an upper layer, wherein the upper layer is disposed over the lower layer, and a glass transition temperature of a binder contained in the lower layer is higher than that of a binder contained in the upper layer.

le;2q2. The photothermographic material of claim 1, wherein a mean radius of spheres of influence of the lower layer (r) than the upper layer is less than that of the upper layer (r').

3. The photothermographic material of claim 1, wherein binders contained in the lower layer and the upper layer are each a polyvinyl acetal having an acetoacetal structure.

4. The photothermographic material of claim 3, wherein said binders are a polymer compound represented by the following formula (V):

formula (V)

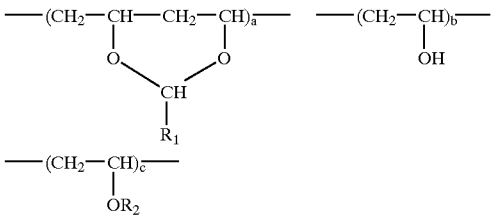

wherein $R_1$ is an alkyl group or an aryl group; $R_2$ is an alkyl group, an aryl group, —$COR_3$ or —$CONHR_3$, in which $R_3$ is the same as defined in R1; a is 40 to 86 mol %, b is 0 to 30 mol % and c is 0 to 60 mol %, provided that the sum of a, b and c is 100 mol %.

5. The photothermographic material of claim 1, wherein a mean radius of spheres of influence of the lower layer (r) than the upper layer is less than that of the upper layer (r').

6. The photothermographic material of claim 2, wherein the mean radius of spheres of influence of the upper layer (r') is 0.30 to 1.10 $\mu$m.

7. The photothermographic material of claim 2, wherein $$0.01 \leqq r/r' \leqq 0.75.$$

8. The photothermographic material of claim 1, wherein the light-sensitive layer contains a silver halide emulsion which has been sensitized with a chalcogen sensitizer.

9. The photothermographic material of claim 8, wherein said chalcogen sensitizer is a compound represented by the following formulas (1-1) and (1-2):

formula (1-1)

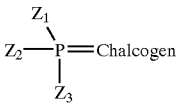

wherein $Z_1$, $Z_2$ and $Z_3$ are each an aliphatic group, an aromatic group, a heterocyclic group, —$OR_7$, —$NR_8(R_9)$, $sR_{10}$, $SeR_{11}$, a halogen atom, or a hydrogen atom, in which $R_7$, $R_{10}$ and $R_{11}$ are each an aliphatic group, an aromatic group, a heterocyclic group, a hydrogen atom or a cation, R8 and $R_9$ are each an aliphatic group, an aromatic group, a heterocyclic group or a hydrogen atom; and "chalcogen" represents a sulfur, selenium or tellurium atom;

formula (1-2)

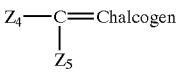

wherein $Z_4$ and $Z_5$ are each an alkyl group, alkenyl group, aralkyl group, aryl group, heterocyclic group, —$NR_1(R_2)$, —$OR_3$ or —$SR_4$, in which $R_1$, $R_2$, $R_3$ and $R_4$ are each an alkyl group, aralkyl group, aryl group or a heterocyclic group, provided that $Z_4$ and $Z_5$ may combine with each other to form a ring; and "chalcogen" represents a sulfur, selenium or tellurium atom.

10. The photothermographic material of claim 1, wherein the light-sensitive layer or the light-insensitive layer contains a silver saving agent.

11. The photothermographic material of claim 10, wherein the silver-saving agent is a compound represented by the following formula (H):

formula (H)

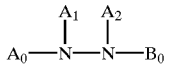

wherein $A_0$ is an aliphatic group, aromatic group, heterocyclic group, or —$G_0$—$D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, —C(=$NG_1D_1$)—, —SO—, —$SO_2$— or —P(O) ($G_1D_1$)— group, in which $G_1$ is a bond, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is a hydrogen atom, an aliphatic group, aromatic group, heterocyclic group, amino group, alkoxy group, aryloxy group, alkylthio group or arylthio group.

12. The photothermographic material of claim 10, wherein the silver-saving agent is a compound represented by the following formula (G):

formula (G)

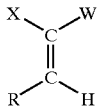

wherein X is an electron-with drawing group; W is a hydrogen atom, an alkyl group, alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfamoyl group, a thiosulfamoyl group, a sulfinamoyl group, a phosphoryl group, nitro group, an imino group, a N-carbonylimino group, a N-sulfonylimino group, a dicyanoethylene group, an ammonium group, a sulfonium group, a phosphonium group, pyrylium group, or an inmonium group; R is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxy or mercapto group, an amino group, a cyclic amino group, an acylamino group, an oxycarbonylamino group, a heterocyclic group, a ureido group, or a sulfonamido group, provided that X and W, or X and R may combine with each other to form a ring.

13. The photothermographic material of claim 10, wherein the silver-saving agent is a compound represented by the following formula (P):

formula (P)

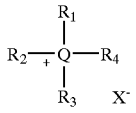

wherein Q is a nitrogen atom or a phosphorus atom; $R_1$, $R_2$, $R_3$ and $R_4$ each are a hydrogen atom, an alkyl group, an alkenyl group, an alkenyl group, an aryl group, a heterocyclic group or an amino group, provided that $R_1$, $R_2$, $R_3$ and $R_4$ may combine together with each other to form a ring; and $X^-$ is an anion.

14. The photothermographic material of claim 1, wherein the light-sensitive layer further contains a reducing agent.

* * * * *